US009805726B2

(12) United States Patent
Adami et al.

(10) Patent No.: US 9,805,726 B2
(45) Date of Patent: Oct. 31, 2017

(54) SEGMENT-WISE ADJUSTMENT OF SPATIAL AUDIO SIGNAL TO DIFFERENT PLAYBACK LOUDSPEAKER SETUP

(71) Applicants: Fraunhofer-Gesellschaft zur Foerderung der angewandten Forschung e.V., Munich (DE); Technische Universitaet Ilmenau, Ilmenau (DE)

(72) Inventors: Alexander Adami, Gundelsheim (DE); Juergen Herre, Erlangen (DE); Achim Kuntz, Hemhofen (DE); Giovanni Del Galdo, Martinroda (DE); Fabian Kuech, Erlangen (DE)

(73) Assignees: Fraunhofer-Gesellschaft zur Foerderung der angewandten Forschung e.V., Munich (DE); Technische Universitaet Ilmenau, Ilmenau (DE)

( * ) Notice: Subject to any disclaimer, the term of this patent is extended or adjusted under 35 U.S.C. 154(b) by 0 days.

(21) Appl. No.: 14/713,292

(22) Filed: May 15, 2015

(65) Prior Publication Data

US 2015/0248891 A1 Sep. 3, 2015
US 2017/0069330 A9 Mar. 9, 2017

Related U.S. Application Data

(63) Continuation of application No. PCT/EP2013/073482, filed on Nov. 11, 2013.
(Continued)

(30) Foreign Application Priority Data

Mar. 15, 2013 (EP) ..... 13159424

(51) Int. Cl.
*H04R 5/02* (2006.01)
*G10L 19/008* (2013.01)
(Continued)

(52) U.S. Cl.
CPC ..... *G10L 19/008* (2013.01); *H04S 5/00* (2013.01); *H04S 7/30* (2013.01); *H04S 7/303* (2013.01)

(58) Field of Classification Search
CPC . G10L 19/008; H04S 5/00; H04S 7/30; H04S 7/303
See application file for complete search history.

(56) References Cited

U.S. PATENT DOCUMENTS

2008/0232617 A1* 9/2008 Goodwin ..... G10L 19/008 381/307
2008/0267413 A1* 10/2008 Faller ..... H04S 3/002 381/1
(Continued)

FOREIGN PATENT DOCUMENTS

CN 101341793 A 1/2009
CN 101843114 A 9/2010
(Continued)

OTHER PUBLICATIONS

Faller, Christof , "Multiple-Loudspeaker Playback of Stereo Signals", Journal of Audio Engineering Society; vol. 54, No. 11, Nov. 2006, pp. 1051-1064.
(Continued)

*Primary Examiner* — Andrew L Sniezek
(74) *Attorney, Agent, or Firm* — Michael A. Glenn; Perkins Coie LLP

(57) ABSTRACT

Apparatus for adapting a spatial audio signal for an original loudspeaker setup to a playback loudspeaker setup that differs from the original loudspeaker setup. The apparatus
(Continued)

includes a direct-ambience decomposer that is configured to decomposing channel signals in a segment of the original loudspeaker setup into direct sound and ambience components, and to determine a direction of arrival of the direct sound components. A direct sound renderer receives a playback loudspeaker setup information and adjusts the direct sound components using the playback loudspeaker setup information so that a perceived direction of arrival of the direct sound components in the playback loudspeaker setup is substantially identical to the direction of arrival of the direct sound components. A combiner combines adjusted direct sound components and possibly modified ambience components to obtain loudspeaker signals for loudspeakers of the playback loudspeaker setup.

16 Claims, 8 Drawing Sheets

Related U.S. Application Data

(60) Provisional application No. 61/726,878, filed on Nov. 15, 2012.

(51) Int. Cl.
*H04S 5/00* (2006.01)
*H04S 7/00* (2006.01)

(56) References Cited

U.S. PATENT DOCUMENTS

| | | | | |
|---|---|---|---|---|
| 2011/0274278 | A1 | 11/2011 | Kim | |
| 2014/0064527 | A1* | 3/2014 | Walther | H04S 3/006 381/307 |

FOREIGN PATENT DOCUMENTS

| | | | |
|---|---|---|---|
| CN | 101884065 | A | 11/2010 |
| GB | 2457508 | A | 8/2009 |
| JP | 3072051 | U | 9/2000 |
| JP | 2003531555 | A | 10/2003 |
| JP | 2005223747 | A | 8/2005 |
| JP | 2007225482 | A | 9/2007 |
| JP | 2010521910 | A | 6/2010 |
| RU | 2437247 | C1 | 12/2011 |
| WO | 2010080451 | A1 | 7/2010 |
| WO | 2011151771 | A1 | 12/2011 |
| WO | 2012032178 | A1 | 3/2012 |

OTHER PUBLICATIONS

Goodwin, M. et al., "Multichannel Surround Format Conversion and Generalized Upmix", AES 30th Int'l Conference on Intelligent Audio Environments; New York, USA, Mar. 1, 2007, pp. 1-9.

* cited by examiner

SEGMENT-WISE ADJUSTMENT OF SPATIAL AUDIO SIGNAL TO DIFFERENT PLAYBACK LOUDSPEAKER SETUP

CROSS-REFERENCE TO RELATED APPLICATIONS

This application is a continuation of copending International Application No. PCT/EP2013/073482, filed Nov. 11, 2013, which is incorporated herein by reference in its entirety, and additionally claims priority from U.S. Application No. 61/726,878, filed Nov. 15, 2012, and European Application No. 13159424.4, filed Mar. 15, 2013, both of which are also incorporated herein by reference in their entirety.

The present invention generally relates to spatial audio signal processing, and in particular to an apparatus and a method for adapting a spatial audio signal intended for an original loudspeaker setup to a playback loudspeaker setup that differs from the original loudspeaker setup. Further embodiments of the present invention relate to flexible high quality multi-channel sound scene conversion.

BACKGROUND OF THE INVENTION

The requirements of a modern audio playback system have changed, during the years. From single channel (mono) to dual channel (stereo) up to multi-channel systems, like 5.1- and 7.1 Surround or even wave field synthesis, the number of used loudspeaker channels has increased. Even systems with elevated speakers are to be seen in modern cinemas. This aims at giving the listener an audio experience of a recorded or artificially created audio scene, with respect to sense of reality, immersion and envelopment that comes as close to the real audio scene as possible or alternatively best reflects the intentions of the sound engineer (see e.g., M. Morimoto, "The Role of Rear Loudspeakers in Spatial Impression", in 103*rd Convention of the AES,* 1997; D. Griesinger, "Spaciousness and Envelopment in Musical Acoustics", in 101*st Convention of the AES,* 1996; K. Hamasaki, K. Hiyama, and R. Okumura, "The 22.2 Multichannel Sound System and Its Application", in 118*th Convention of the AES,* 2005). However, there are at least two drawbacks: due to the plurality of available sound systems, with respect to the number of used loudspeakers and their recommended positioning, there is no general compatibility between all these systems. Furthermore, any deviation from the recommended loudspeaker positioning will result in a compromised audio scene and, therefore, decreases the spatial audio experience of the listener, and hence, the spatial quality.

In a real world application, multi-channel playback systems are often not configured correctly with respect to loudspeaker positioning. In order not to distort the original spatial image of an audio scene which would result from a faulty positioning, a flexible high quality system is needed which is able to compensate for these setup mismatches. State-of-the-art approaches often lack the ability to describe a complex and maybe artificially-generated sound scene where, for example, more than one direct source per frequency band and time instant appears.

SUMMARY

According to an embodiment, an apparatus for adapting a spatial audio signal for an original loudspeaker setup to a playback loudspeaker setup that differs from the original loudspeaker setup, wherein the spatial audio signal has a plurality of channel signals, may have: a grouper configured to group at least two channel signals into a segment; a direct-ambience decomposer configured to decompose the at least two channel signals in the segment into at least one direct sound component and at least one ambience component, and to determine a direction of arrival of the at least one direct sound component; a direct sound renderer configured to receive a playback loudspeaker setup information for at least one playback segment associated with the segment and to adjust the at least one direct sound component using the playback loudspeaker setup information for the segment so that a perceived direction of arrival of the at least one direct sound component in the playback loudspeaker setup is identical to the direction of arrival of the segment or closer to the direction of arrival of the at least one direct sound component compared to a situation in which no adjusting has taken place; and a combiner configured to combine adjusted direct sound components and the ambience components or modified ambience components to acquire loudspeaker signals for at least two loudspeakers of the playback loudspeaker setup.

According to another embodiment, a method for adapting a spatial audio signal for an original loudspeaker setup to a playback loudspeaker setup that differs from the original loudspeaker setup, wherein the spatial audio signal has a plurality of channels, may have the steps of: grouping at least two channel signals into a segment; decomposing the at least two channel signals in the segment into direct sound components and ambience components; determining a direction of arrival of the direct sound components; adjusting the direct sound components using a playback loudspeaker setup information for the segment so that a perceived direction of arrival of the direct sound components in the playback loudspeaker setup is identical to the direction of arrival of the segment or closer to the direction of arrival of the segment compared to a situation in which no adjusting has taken place; and combining adjusted direct sound components and the ambience components or modified ambience components to acquire loudspeaker signals for at least two loudspeakers of the playback loudspeaker setup.

Another embodiment may have a computer program having a program code for performing the method according to claim 14 when the computer program is executed on a computer.

The basic idea underlying of the present invention is to group neighboring loudspeaker channels into segments (e.g., circular sectors, cylindrical sectors, or spherical sectors) and to decompose each segment signal into corresponding direct and ambient signal parts. The direct signals lead to a phantom source position (or several phantom source positions) within each segment, while the ambient signals correspond to diffuse sound and are responsible for the envelopment of the listener. During the rendering process, the direct components are remapped, weighted and adjusted by means of the phantom source positions to fit the actual playback loudspeaker setup and preserve the original localization of the sources. Ambient components are remapped and weighted to produce the same amount of envelopment in the modified listening setup. At least some of the processing may be carried out on a time-frequency bin basis. With this methodology, even an increased or decreased number of loudspeakers in the output setup can be handled.

A segment of the original loudspeaker setup may also be called an "original segment", for easier reference in the following description. Likewise, a segment in the playback loudspeaker setup may also be called a "playback segment".

A segment is typically spanned or delimited by two or more loudspeakers and a position of a listener, that is, a segment typically corresponds to the space that is delimited by the two or more loudspeakers and a listener. A given loudspeaker may be assigned to two or more segments. In a two-dimensional loudspeaker setup a particular loudspeaker is typically assigned to a "left" segment and a "right" segment, that is, the loudspeaker emits sound primarily into the left and right segments. The grouper (or grouping element) is configured to gather those channel signals that are associated with a given segment. As each channel signal may be assigned to two or more channels, it may be distributed to these two or more segments by the grouper or by several groupers.

The direct-ambience decomposer may be configured to determine the direct sound components and the ambience components for each channel. Alternatively, the direct-ambience decomposer may be configured to determine a single direct sound component and a single ambience component per segment. The direction(s) of arrival may be determined by analyzing (e.g., cross-correlating) the at least two channel signals. As an alternative, the direction(s) of arrival may be determined on the basis of information provided to the direct-ambience decomposer from a further component of the apparatus or from an external entity.

The direct sound renderer may typically consider how a difference between the original loudspeaker setup and the playback loudspeaker setup affects a currently contemplated segment of the original loudspeaker setup, and which measures have to be taken in order to maintain the perception of the direct sound components within said segment. These measures may comprise (non-exhaustive list):

- modifying an amplitude weighting of the direct sound component among the loudspeakers of said segment;
- modifying a phase relation and/or delay relation between the loudspeaker-specific direct sound components for the loudspeakers of said segment;
- removing the direct sound component for said segment from a particular loudspeaker due to the availability of a better suited loudspeaker in the playback loudspeaker setup;
- applying the direct sound component for a neighboring segment in the original loudspeaker setup to a loudspeaker in the currently contemplated segment because said loudspeaker is better suited for reproducing said direct sound component (e.g., due to a segment border having crossed the direction of arrival for a phantom source when passing from the original loudspeaker setup to the playback loudspeaker setup);
- applying the direct sound component to an added loudspeaker (additional loudspeaker) that is available in the playback loudspeaker setup but not in the original loudspeaker setup;
- possible further measures as described below.

The direct-sound renderer may comprise a plurality of segment renderers, each segment renderer performing the processing of the channel signals of one segment.

The combiner may combine adjusted direct sound components, ambience components, and/or modified ambience components that have been generated by the direct sound renderer (or a further direct sound renderer) for one or more neighboring segments relative to a currently contemplated segment. According to some embodiments the ambience components may be substantially identical to the at least one ambience component determined by the direct-ambience decomposer. According to alternative embodiments, the modified ambience components may be determined on the basis of the ambience components determined by the direct-ambience decomposer taking into account a difference between the original segment and the playback segment.

According to a further embodiment the playback loudspeaker setup may comprise an additional loudspeaker within the segment. Hence, the segment of the original loudspeaker setup corresponds to two or more segments of the playback loudspeaker segment, i.e. the original segment in the original loudspeaker setup has been divided into two or more playback segments in the playback loudspeaker setup. The direct sound renderer may be configured to generate the adjusted direct sound components for the at least two loudspeakers and the additional loudspeaker of the playback loudspeaker setup.

The opposite case is also possible: According to a further embodiment, the playback loudspeaker setup may lack a loudspeaker compared to the original loudspeaker setup so that the segment and a neighboring segment of the original loudspeaker setup are merged to one merged segment of the playback loudspeaker setup. The direct sound renderer may then be configured to distribute adjusted direct sound components of a channel signal corresponding to the loudspeaker that lacks in the playback loudspeaker setup to at least two remaining loudspeakers of the merged segment of the playback loudspeaker setup. The loudspeaker which is present in the original loudspeaker setup but not in the playback loudspeaker setup may also be referred to as "lacking loudspeaker".

According to further embodiments, the direct sound renderer may be configured to reallocate a direct sound component having a determined direction of arrival from the segment in the original loudspeaker setup to a neighboring segment in the playback loudspeaker setup if a boundary between the segment and the neighboring segment trespasses or crosses the determined direction of arrival when passing from the original loudspeaker setup to the playback loudspeaker setup.

According to further embodiments, the direct sound renderer may be further configured to reallocate the direct sound component having the determined direction of arrival from at least one first loudspeaker to at least one second loudspeaker, the at least one first loudspeaker being assigned to the segment in the original loudspeaker setup but not to the neighboring segment in the playback loudspeaker setup and the at least one second loudspeaker being assigned to the neighboring segment in the playback loudspeaker setup.

According to further embodiments, the direct sound renderer may be configured to generate loudspeaker-segment-specific direct sound components for at least two valid loudspeaker-segment pairs of the playback loudspeaker setup, the at least two valid loudspeaker-segment pairs referring to a same loudspeaker and two neighboring segments in the playback loudspeaker setup. The combiner may be configured to combine the loudspeaker-segment-specific direct sound components for the at least two valid loudspeaker-segment pairs referring to the same loudspeaker to obtain one of the loudspeaker signals for the at least two loudspeakers of the playback loudspeaker setup. A valid loudspeaker-segment pair refers to a loudspeaker and one of the segments this loudspeaker is assigned to. The loudspeaker may be part of further valid loudspeaker-segment pairs if the loudspeaker is assigned to further segments (as is typically the case). Likewise, the segment may be (and typically is) part of further valid loudspeaker-segment pairs. The direct sound renderer may be configured to consider this ambivalence of each loudspeaker and provide segment-specific direct sound components for the loudspeaker. The combiner may be configured to gather the different segment-specific direct sound components (and possibly, as the case may be, segment-specific ambient components, as well) intended for a particular loudspeaker of the playback loudspeaker setup from the various segments that this particular loudspeaker is assigned to. Note that the addition or the removal of a loudspeaker in the playback loudspeaker setup may have an impact on the valid loudspeaker-segment pairs: The addition of a loudspeaker typically divides an original segment in at least two playback segments so that the affected loudspeakers are assigned to new segments in the playback loudspeaker setup. The removal of a loudspeaker may result in two or more original segments being merged to one playback segment and a corresponding influence on the valid loudspeaker-segment pairs.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
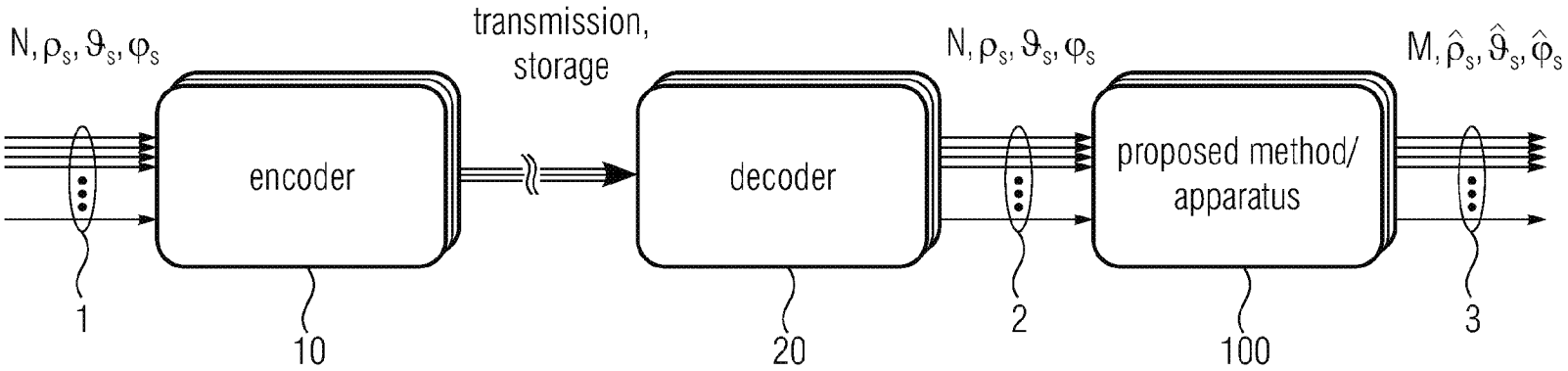
FIG. 1 shows a schematic block diagram of a possible application scenario.

Before discussing the present invention in further detail using the drawings, it is pointed out that in the figures identical elements, elements having the same function or the same effect are provided with the same or similar reference numerals so that the description of these elements and the functionality thereof illustrated in the different embodiments is mutually exchangeable or may be applied to one another in the different embodiments.

Some methods for adjusting a spatial audio signal are not flexible enough to handle a complex sound scene, especially those which are based on global physical assumptions (see e.g., V. Pulkki, "Spatial Sound Reproduction with Directional Audio Coding", *J. Audio Eng. Soc*, vol. 55, no. 6, pp. 503-516, 2007 and V. Pulkki and J. Herre, "Method and Apparatus for Conversion Between Multi-Channel Audio Formats", US Patent Application Publication No. US 2008/0232616 A1) or which are restricted to one locatable (direct) component per frequency band in the whole audio scene (see e.g., M. Goodwin and J.-M. Jot, "Spatial Audio Scene Coding", in 125*th Convention of the AES,* 2008 and J. Thompson, B. Smith, A. Warner, and J.-M. Jot, "Direct-Diffuse Decomposition of Multi-channel Signals Using a System of Pairwise Correlations", in 133*rd Convention of the AES* 2012, October 2012). The one plane wave or direct component assumption might be sufficient in some special scenarios but is, in general, not capable of capturing a complex audio scene with several active sources at a time. This results in spatial distortion and unstable or even jumping sources during playback.

There are systems modeling input-setup loudspeakers which do not match the output setup as virtual speakers (the whole loudspeaker signal is panned by neighboring speakers to the intended position of the loudspeaker) (A. Ando, "Conversion of Multichannel Sound Signal Maintaining Physical Properties of Sound in Reproduced Sound Field", *IEEE Transactions on Audio, Speech, and Language Processing*, vol. 19, no. 6, pp. 1467-1475, 2011). This also may result in spatial distortion of phantom sources to which those speaker channels contribute. The approach mentioned by A. Laborie, R. Bruno, and S. Montoya in "Reproducing Multichannel Sound on any Speaker Layout", 118*th Convention of the AES,* 2005, needs the user to first calibrate his loudspeakers and afterwards renders the signals for that setup out of a computational intensive signal transform.

Furthermore, a high quality system should be waveform-preserving. When the input channels are rendered to a loudspeaker setup which equals the input setup, the waveform should not change significantly, otherwise information gets lost which can result in audible artifacts and decreasing spatial and audio quality. Object-based methods might suffer here from additional crosstalk which is introduced during object extraction (F. Melchior, "Vorrichtung zum Verändern einer Audio-Szene and Vorrichtung zum Erzeugen einer Richtungsfunktion", German Patent Application No. DE 10 2010 030 534 A1, 2011). Global physical assumptions also result in different waveforms (see for example M. Goodwin and J.-M. Jot, "Spatial Audio Scene Coding", in 125*th Convention of the AES,* 2008; V. Pulkki, "Spatial Sound Reproduction with Directional Audio Coding", *J. Audio Eng. Soc*, vol. 55, no. 6, pp. 503-516, 2007; and V. Pulkki and J. Herre, "Method and Apparatus for Conversion Between Multi-Channel Audio Formats", US Patent Application Publication No. US 2008/0232616 A1).

A multi-channel panner may be used to place a phantom source somewhere in the audio scene. The algorithms mentioned by Eppolito, Pulkki, and Blauert are based on relatively simple assumptions which may cause severe inaccuracies in the spatial location where a source was panned to and where the source is perceived at (A. Eppolito, "Multi-Channel Sound Panner", U.S. Patent Application Publication No. US 2012/0170758 A1; V. Pulkki, "Virtual Sound Source Positioning Using Vector Base Amplitude Panning", J. Audio Eng. Soc, vol. 45, no. 6, pp. 456-466, 1997; and J. Blauert, "Spatial hearing: The psychophysics of human sound localization", 3*rd ed. Cambridge and Mass: MIT Press,* 2001, section 2.2.2).

Ambience extracting upmix methods are designed to extract the ambient signal parts and distribute them among the additional speakers to generate a certain amount of envelopment (J. S. Usher and J. Benesty, "Enhancement of Spatial Sound Quality: A New Reverberation-Extraction Audio Upmixer", *IEEE Transactions on Audio, Speech, and Language Processing*, vol. 15, no. 7, pp. 2141-2150, 2007; C. Faller, "Multiple-Loudspeaker Playback of Stereo Signals", J. Audio Eng. Soc, vol. 54, no. 11, pp. 1051-1064, 2006; C. Avendano and J.-M. Jot, "Ambience extraction and synthesis from stereo signals for multi-channel audio upmix", in *Acoustics, Speech, and Signal Processing* (*ICASSP*), 2002 IEEE International Conference on, vol. 2, 2002, pp. II-1957-II-1960; and R. Irwan and R. M. Aarts, "Two-to-Five Channel Sound Processing", *J. Audio Eng. Soc*, vol. 50, no. 11, pp. 914-926, 2002). The extraction is based on only one or two channels, which is why the resulting audio scene is not an accurate image of the original scene anymore, and why these are not useful approaches for our purposes. This also is true for matrixing approaches as described by Dressler in "Dolby Surround Pro Logic II Decoder Principles of Operation" (available online, address is indicated below). The two-to-three upmix approach mentioned by Vickers in U.S. Patent Application Publication No. US 2010/0296672 A1 "Two-to-Three Channel Upmix for Center Channel Derivation" utilizes some prior knowledge about the position of the third speaker and the resulting signal distribution among the other two speakers and therefore lacks the ability to generate accurate signals for an arbitrary position of the inserted speaker.

Embodiments of the present invention aim at providing a system which is capable of preserving the original audio scene in a playback environment, where the loudspeaker setup deviates from the original one by grouping suitable speakers to segments and applying an upmix, downmix and/or displacement adjustment processing. A post processing stage to a regular audio codec could be a possible application scenario. Such a case is depicted in FIG. 1, where N, $\rho_s$, $\theta_s$, $\phi_s$ and M, $\hat{\rho}_s$, $\hat{\theta}_s$, $\hat{\phi}_s$ are the number of loudspeakers and their corresponding positions in polar coordinates in the original and modified/displaced loudspeaker setup respectively. In general, however, the proposed method is applicable to any audio signal chain as a post processing tool. In embodiments, the segments of the loudspeaker setup (original and/or playback loudspeaker setup) each represent a subset of directions within a two-dimensional (2D) plane or within a three-dimensional (3D) space. According to embodiments, for a planar two-dimensional (2D) loudspeaker setup, the entire azimuthal angle range of interest can be divided into multiple segments (sectors) covering a reduced range of azimuthal angles. Analogously, in the 3D case the full solid angle range (azimuthal and elevation) can be divided into segments covering a smaller angle range.

Each segment may be characterized by an associated direction measure, which can be used to specify or refer to the corresponding segment. The directional measure can, for example, be a vector pointing to the center of the segment, or an azimuthal angle in the 2D case, or a set of an azimuth and an elevation angle in the 3D case. The segment can be referred to as both a subset of directions within a 2D plane or within a 3D space. For presentational simplicity, the following examples are exemplarily described for the 2D case; however the extension to 3D configurations is straightforward.

FIG. 1 shows a schematic block diagram of the above mentioned possible application scenario for an apparatus and/or a method for adjusting a spatial audio signal. An encoder side spatial audio signal 1 is encoded by an encoder 10. The encoder side spatial audio signal has N channels and has been produced for an original loudspeaker setup, for example a 5.0 loudspeaker setup or a 5.1 loudspeaker setup with loudspeaker positions at 0 degrees, +/−30 degrees, and +/−110 degrees with respect to an orientation of a listener. The encoder 10 produces an encoded audio signal which may be transmitted or stored. Typically, the encoded audio signal has been compressed compared to the encoder side spatial audio signal 1 in order to relax the requirements for storage and/or transmission. A decoder 20 is provided to decode and in particular decompress the encoded spatial audio signal. The decoder 20 produces a decoded spatial audio signal 2 that is highly similar or even identical to the encoder side spatial audio signal 1. At this point in the processing of the spatial audio signal a method or an apparatus 100 for adjusting a spatial audio signal may be employed. The purpose of the method or apparatus 100 is to adjust the spatial audio signal 2 to a playback loudspeaker setup that differs from the original loudspeaker setup. The method or apparatus provides an adjusted spatial audio signal 3 or 4 that is tailored to the playback loudspeaker setup at hand.

Figure 2:
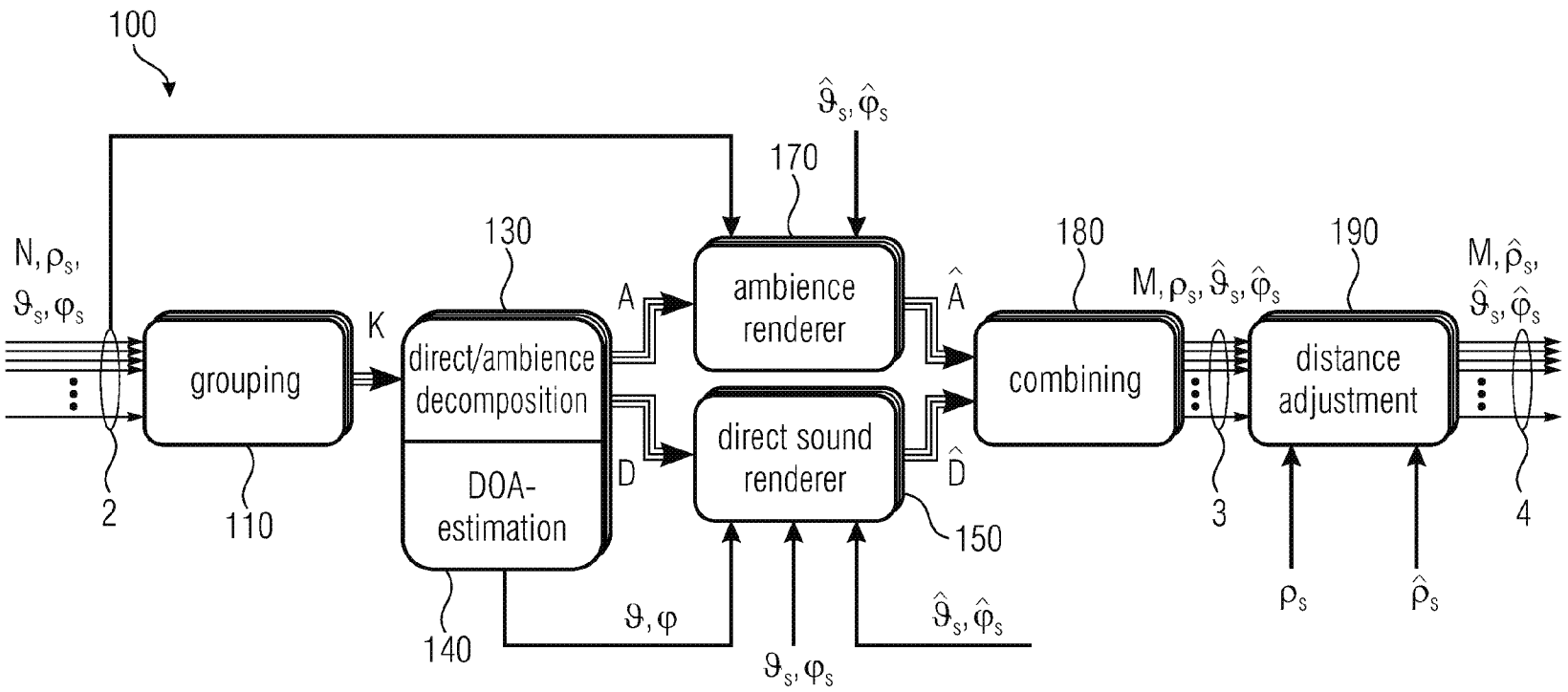
FIG. 2 shows a schematic block diagram of a system overview of an apparatus and a method for adjusting a spatial audio signal.

A system overview of the proposed method is depicted in FIG. 2. The short time frequency domain representation of the input channels are grouped into K segments by a grouper 110 (grouping element) and fed into a Direct/Ambience-Decomposition 130 and DOA-Estimation stage 140, where A are the ambience and D the direct signals per speaker and segment and θ, ϕ are the estimated DOAs per segment. These signals are fed into an ambience renderer 170 or a direct sound renderer 150 respectively, resulting in the newly-rendered direct and ambience signals $\hat{A}$ and $\hat{D}$ per speaker and segment for the output setup. The segment signals are combined by a combiner 180 into the angularly corrected output signals. To compensate for displacements in the output setup with respect to distance, the channels are scaled and delayed in a distance adjustment stage 190 to finally result in the playback setup's speaker channels. The said method can also be extended to handle playback setups with an increased as well as decreased number of loudspeakers and is described below.

Figure 3:
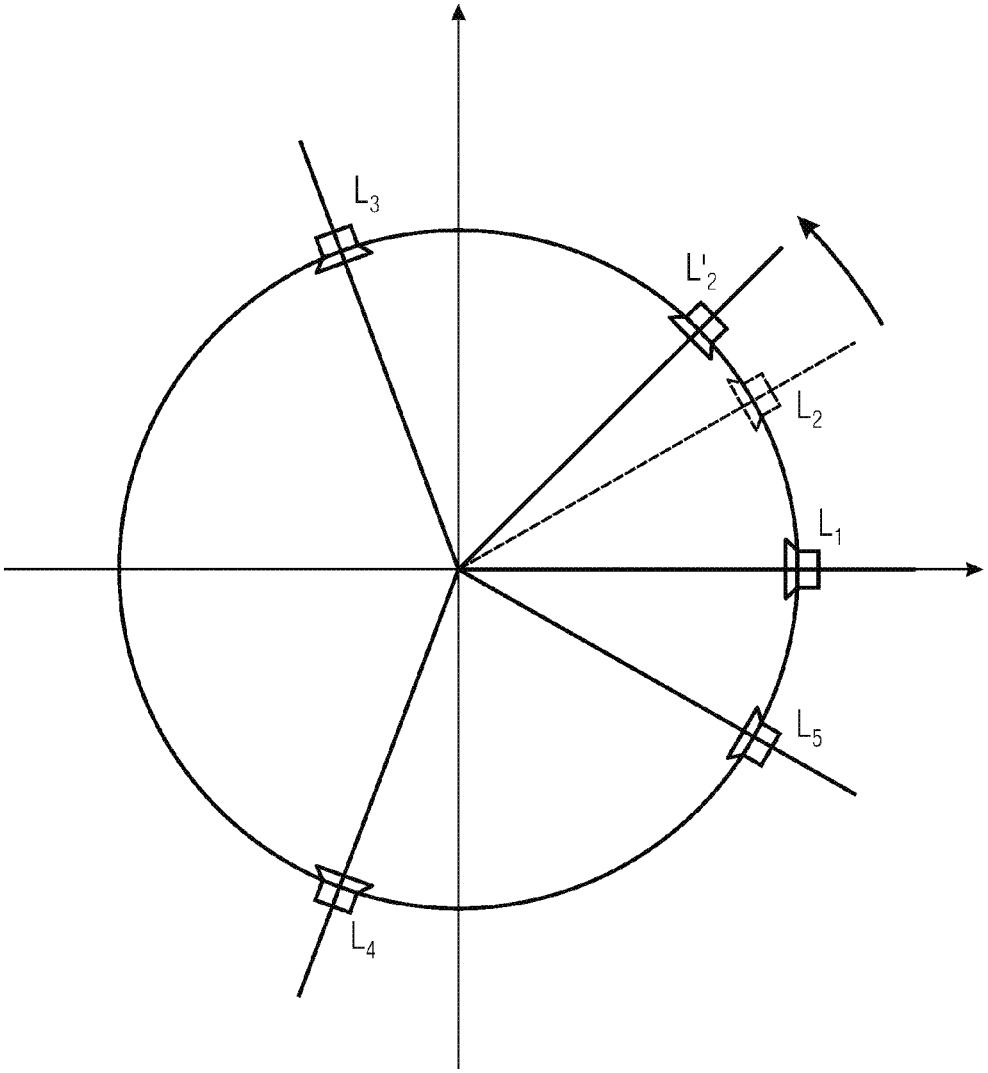
FIG. 3 shows a schematic illustration of an example for a modified loudspeaker setup with one loudspeaker having been moved/displaced.

In a first step, the method or the apparatus groups suitable neighboring loudspeaker signals to K segments, whereas each speaker signal can contribute to several segments and each segment consists of at least two speaker signals. In a loudspeaker setup like the one depicted in FIG. 3, the input setup segments, for example, would be formed by the speaker pairs $Seg_{in}=[\{L_1,L_2\}, \{L_2,L_3\}, \{L_3,L_4\}, \{L_4,L_5\}, \{L_5,L_1\}]$ and the output segments would be $Seg_{out}=[\{L_1, L'_2\}, \{L'_2,L_3\}, \{L_3,L_4\}, \{L_4,L_5\}, \{L_5,L_1\}]$. The loudspeaker $L_2$ in the original loudspeaker setup (loudspeaker drawn in dashed line) was modified to a moved or displaced loudspeaker $L'_2$ in the playback loudspeaker setup.

During the analysis, a normalized cross-correlation based Direct/Ambience-Decomposition per segment is carried out, resulting in direct signal components D and ambience signal components A for each loudspeaker (for each channel) with respect to each considered segment. This means, the proposed method/apparatus is capable of estimating the direct and ambient signals for a different source within each segment. The Direct/Ambience-Decomposition is not restricted to the mentioned normalized cross-correlation based approach but can be carried out with any suitable decomposition algorithm. The number of generated direct and ambience signals per segment goes from at least one up to the number of contributing loudspeakers to the considered segment. For example, for the input setup given in FIG. 3, there are at least one direct and one ambient signal or maximally two direct and two ambient signals per segment.

Furthermore, since one particular speaker signal is contributing to several segments during the Direct/-Ambience-Decomposition, the signals may be scaled down or partitioned before entering the Direct/-Ambience-Decomposition. The easiest way of doing that would be a downscaling of every speaker signal within each segment by the number of segments to which that particular speaker contributes. For example, for the case in FIG. 3 every speaker channel contributes to two segments, so the downscaling factor would be ½ for every speaker channels. But in general, a more sophisticated and unbalanced partitioning is also possible.

A direction-of-arrival estimation stage (DOA-estimation stage) 140 may be attached to the Direct/Ambience-Decomposition 130. The DOAs, consisting of an azimuth angle θ and possibly an elevation angle ϕ, are estimated per segment and frequency band and in accordance with the chosen Direct/Ambience-Decomposition method. For example, if the normalized cross-correlation decomposition method is used, the DOA-Estimation utilizes energy considerations of the input and extracted direct sound signals for the estimation. In general, however, it can be chosen between several Direct/Ambience-Decompositions and position detection algorithms.

In the rendering stage 170, 150 (Ambience and Direct Sound Renderer) the actual conversion between input and output speaker setup takes place, with direct and ambience signals being treated separately and differently. Any modification to the input setup can be described as a combination of three basic cases: Insertion, removal, and displacement of loudspeakers. For simplicity reasons, these cases are described individually but in a real world scenario they occur simultaneously and, therefore, are also treated simultaneously. This is carried out by superimposing the basic cases. Insertion and removal of speakers affect only the considered segments and is to be seen as a segment based up- and downmix technique. During the rendering, the direct signals may be fed into a repanning function, which assures a correct localization of the phantom sources in the output setup. To do so, the signals may be "inverse panned" with respect to the input setup and panned again with respect to the output setup. This can be achieved by applying repanning coefficients to the direct signals within a segment. A possible implementation, e.g. for the displacement case, of the repanning coefficient $c_{D,k}^{s}$ could be as follows:

$$c_{D,k}^{s} = \frac{h_k^s + \epsilon}{g_k^s + \epsilon}, \tag{1}$$

where $g_k^s$ are the panning gains in the input setup (derived from the estimated DOAs) and $h_k^s$ are the panning gains for the output setup. k=1 . . . K indicates the considered segment and s=1 . . . S the considered speaker within the segment. ϵ is a small regularization constant. This yields for the repanned direct signals:

$$\hat{D}_k^s = c_{D,k}^s \cdot D_k^s. \tag{2}$$

In any segment in which the contributing loudspeakers match in input and output setup, this results in a multiplication by 1 and leaves the extracted direct components unchanged.

A correction coefficient is also applied to the ambient signals which in general depends on how much the segment sizes have changed. The correction coefficient could be implemented as follows:

$$c_{A,k} = \sqrt{\frac{\angle Seg_{out}[k]}{\angle Seg_{in}[k]}}, \tag{3}$$

where $\angle Seg_{in}[k]$ and $\angle Seg_{out}[k]$ denote the angle between loudspeaker positions within segment k in input setup (original loudspeaker setup) or output setup (playback loudspeaker setup), respectively. This yields for the corrected ambience signals:

$$A_k^s = c_{A,k} \cdot A_k^s \tag{4}$$

Like the direct signals, in any segment in which the contributing speakers match in input and output setup, the ambient signals are multiplied by one and left unchanged. This behavior of direct and ambience rendering guarantees a waveform-preserving processing of a particular speaker channel if none of the segments to which the speaker channel contributes suffers from changes. Moreover, the processing converges smoothly to the waveform preserving solution if the speaker positions of the segments are progressively moved towards the positions of the input setup.

Figure 4:
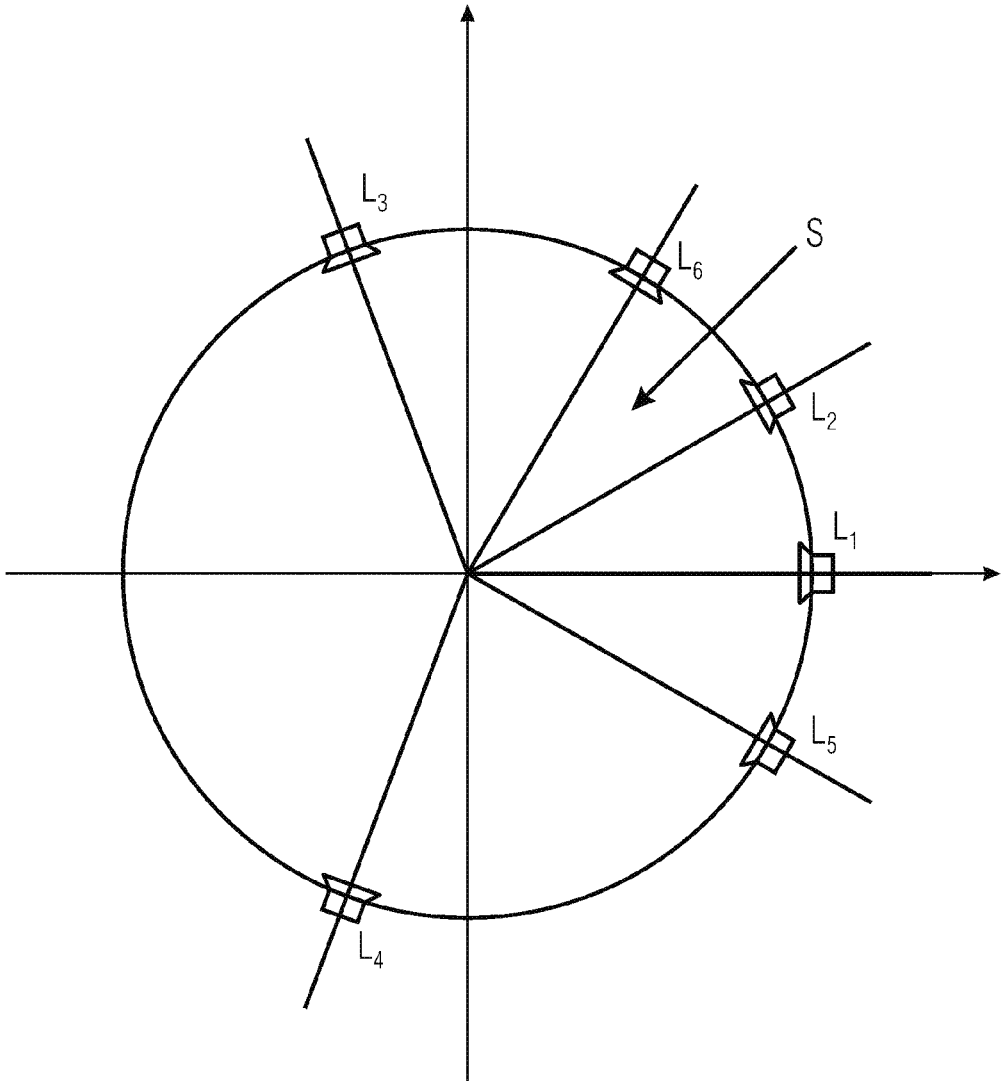
FIG. 4 shows a schematic illustration of an example for another modified loudspeaker setup with an increased number of loudspeakers.

FIG. 4 visualizes a scenario where a speaker ($L_6$) was added to a standard 5.1 loudspeaker configuration, i.e., an increased number of loudspeakers. Adding a loudspeaker may result in one or more of the following effects: The off-sweet-spot stability of the audio scene may be improved, i.e. an enhanced stability of the perceived spatial audio scene if a listener moves out of the ideal listening point (so called sweet-spot). The envelopment of the listener may be improved and/or the spatial localization may be improved, e.g. if a phantom source is replaced by a real loudspeaker. In the FIG. 4, S denotes an estimated phantom source position in the segment formed by speakers $L_2$ and $L_3$. The estimated phantom source position may be determined on the basis of the direct/ambience decomposition performed by direct/ambience decomposer 130 and the direction-of-arrival estimation for one or more phantom sources within the segment. For the added speaker an appropriate direct and ambience signal has to be created and the direct and ambient signals of the neighboring speakers have to be adjusted. This results effectively in an upmix for the current segment with a signal handling as follows:

Direct Signals: In the playback loudspeaker setup (output setup) with the additional speaker $L_6$, the phantom source S is assigned to the segment $\{L_2, L_6\}$ in the playback loudspeaker setup. Therefore, the direct signal parts corresponding to S in original loudspeaker or channel $L_3$ have to be reassigned and reallocated to the additional loudspeaker $L_6$ and processed by a repanning function, which assures that the perceived position of S remains the same in the playback loudspeaker setup. The reallocation includes removing the reallocated signals from $L_3$. Direct parts of S in $L_2$ also have to be processed by the repanning.

Ambient Signals: The ambient signal for $L_6$ is generated out of the ambient signal parts in $L_2$ and $L_3$ and passed to a decorrelator to assure an ambient perception of the generated signals. The energies of the ambient signals in $L_2$, $L_6$ and $L_3$ (every speaker of the newly formed output setup segments $\{L_2, L_6\}$ and $\{L_6, L_3\}$) are adjusted according to a selectable Ambience Energy Remapping Scheme, which in the following is referred to as AERS. Part of these schemes is a Constant Ambience Energy (CAE) scheme, where the overall ambience energy is kept constant, and a Constant Ambience Density (CAD) scheme, where the ambience energy density within a segment is kept constant (e.g. the ambience energy density within the new segments $\{L_2, L_6\}$ and $\{L_6, L_3\}$ should be the same as in the original segment $\{L_2, L_3\}$). These schemes are in the following abbreviated as CAE and CAD respectively.

If S is positioned in the playback segment $\{L_6, L_3\}$ the processing of direct and ambient signals follow the same rules and is carried out analogously.

As illustrated in FIG. 4, the playback loudspeaker setup comprises an additional loudspeaker $L_6$ within the original segment $\{L_2, L_3\}$ so that the original segment of the original loudspeaker setup corresponds to two segments $\{L_2, L_6\}$ and $\{L_6, L_3\}$ of the playback loudspeaker setup. In general, the original segment may correspond to two or more segments of the playback segments, i.e., the additional loudspeaker subdivides the original segment in two or more segments. The direct sound renderer 150 is in this scenario configured to generate the adjusted direct sound components for the at least two loudspeakers $L_2$, $L_3$ and for the additional loudspeaker $L_6$ of the playback loudspeaker setup.

Figure 5:
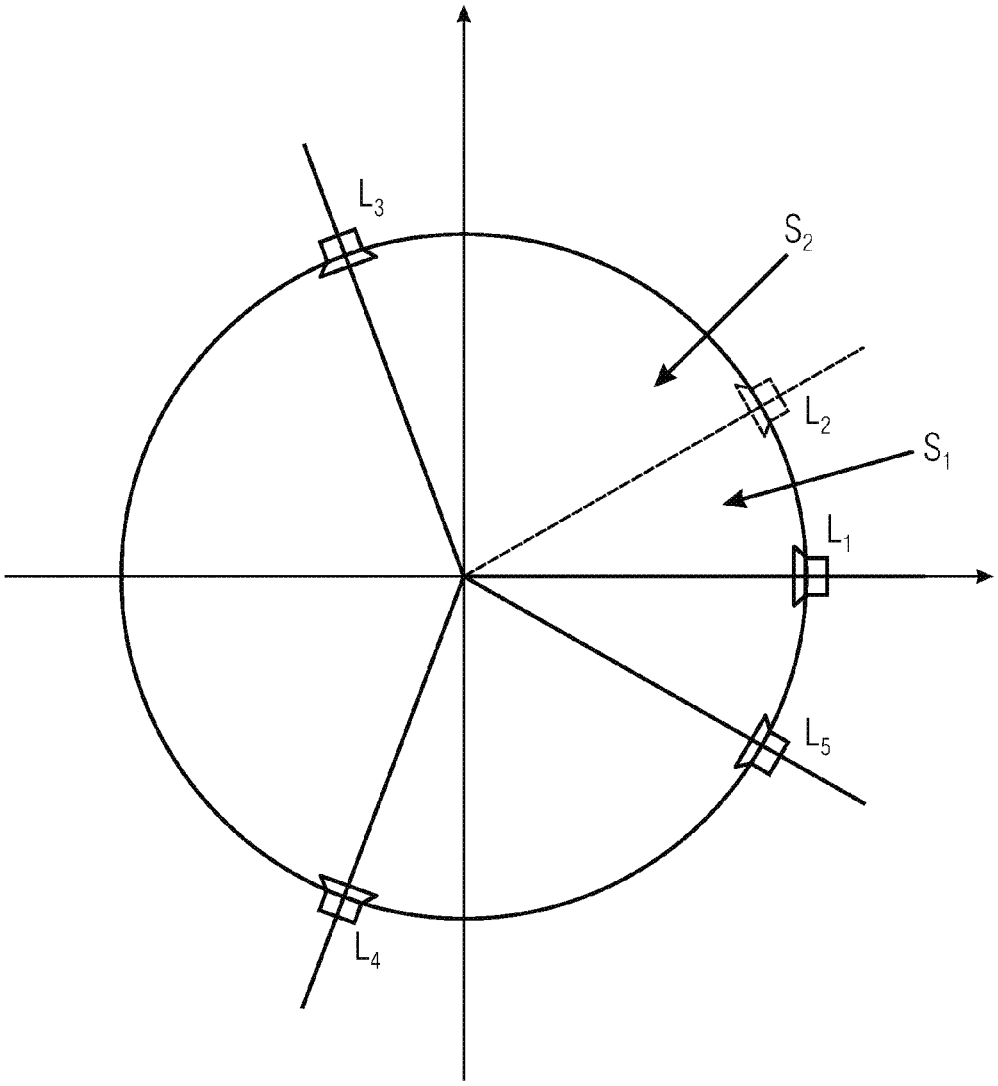
FIG. 5 shows a schematic illustration of an example for another modified loudspeaker setup with a decreased number of loudspeakers.

FIG. 5 schematically illustrates a situation of a decreased number of loudspeakers in the playback loudspeaker setup compared to the original loudspeaker setup. In FIG. 5, a scenario is depicted where a speaker ($L_2$) was removed from a standard 5.1 loudspeaker setup. $S_1$ and $S_2$ represent estimated phantom source positions per frequency band in the input setup segments $\{L_1, L_2\}$ and $\{L_2, L_3\}$ respectively. The signal handling, described below, effectively results in a downmix of the two segments $\{L_1, L_2\}$ and $\{L_2, L_3\}$ to a new segment $\{L_1, L_3\}$.

Direct Signals: Direct signal parts of $L_2$ have to be reallocated to $L_1$ and $L_3$ and merged, such that the perceived phantom source positions $S_1$ and $S_2$ do not change. This is done by reallocating direct parts of $S_1$ in $L_2$ to $L_3$ and direct parts of $S_2$ in $L_2$ to $L_1$. Corresponding signals of $S_1$ and $S_2$ in $L_1$ and $L_3$ are processed by a repanning function, which assures the correct perception of the phantom source positions in the playback loudspeaker setup. The merging is carried out by a superposition of the corresponding signals.

Ambient Signals: The ambient signals corresponding to the segments $\{L_1, L_2\}$ and $\{L_2, L_3\}$ both located in $L_2$ are reallocated to $L_1$ and $L_3$ respectively. Again, the reallocated signals are scaled according to one of the introduced Ambience Energy Remapping Schemes (AERSs) and merged with the original ambient signals in $L_1$ and $L_3$.

As illustrated in FIG. 5, the playback loudspeaker setup lacks the loudspeaker $L_2$ compared to the original loudspeaker setup so that the segment $\{L_1, L_2\}$ and a neighboring segment $\{L_2, L_3\}$ are merged to one merged segment of the playback loudspeaker setup. In general and in particular in a three-dimensional loudspeaker setup, the removal of a loudspeaker may result in several original segments being merged to one playback segment.

Figure 6B:
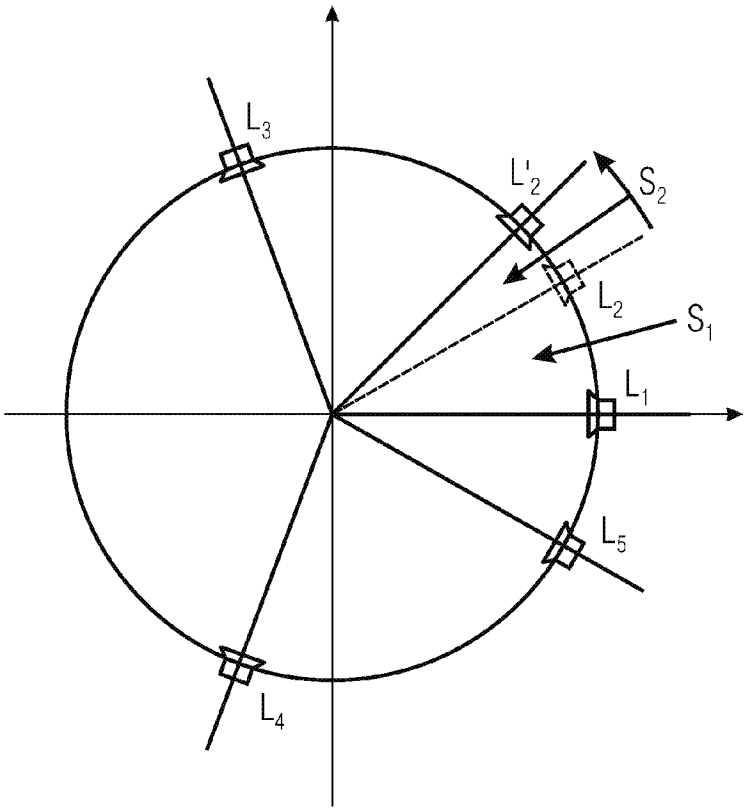
FIGS. 6A and 6B show schematic illustrations of examples for further modified loudspeaker setups with displaced loudspeakers.
Figure 6A:
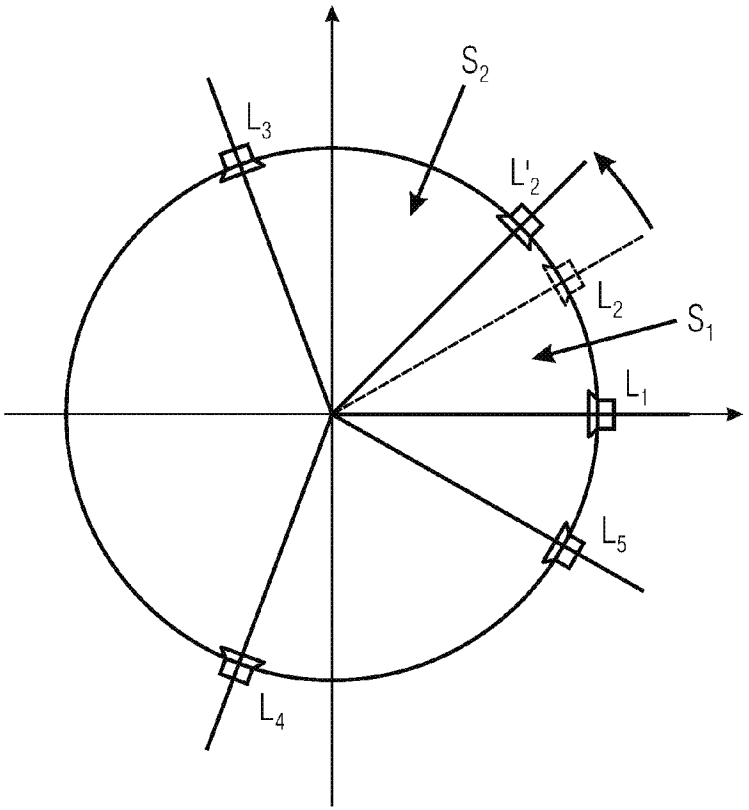

FIGS. 6A and 6B schematically illustrate two situations of displaced loudspeakers. In particular, the loudspeaker $L_2$ in the original loudspeaker setup was moved to a new position and is referred to as loudspeaker $L'_2$ in the playback loudspeaker setup. A proposed processing for the case of a displaced loudspeaker is as follows.

Two examples for possible loudspeaker displacement scenarios are depicted in FIGS. 6A and 6B, where in FIG. 6A just a segment resizing occurs and no reallocation of a phantom source becomes necessary, whereas in FIG. 6B the displaced speaker $L'_2$ is moved beyond the estimated position (direction) of the phantom source $S_2$ and, therefore, the source needs to be reallocated and merged to output segment $\{L_1, L'_2\}$. The original loudspeaker $L_2$ and its direction from the perspective of the listener are drawn in dashed lines in FIGS. 6A and 6B.

In the case schematically illustrated in FIG. 6A, the direct signals are processed as follows. As stated before, a reallocation is not necessary. Thus, the processing is confined to passing the direct signal component of S1 and S2 in the speakers $L_1$, $L_2$ and $L_3$, respectively, to the repanning function, which adjusts the signals such that the phantom sources are perceived at their original position with the displaced loudspeaker $L'_2$.

The ambient signals in the case shown in FIG. 6A are processed as follows. Since there is also no need for signal reallocations, the ambient signals in the corresponding segments and speakers are simply adjusted according to one of the AERSs.

With respect to FIG. 6B the processing of the direct signals is described now. If a speaker is moved beyond a phantom source position this source may be reallocated to a different output segment. Here, the according source signal of $S_2$ has to be reallocated to the output segment $\{L_1, L'_2\}$ and processed by the repanning function to assure an equal source position perception. Additionally, the corresponding source signals of $S_2$ in $\{L_1, L_2\}$ have to be repanned to match the new output segment $\{L_1, L'_2\}$ and both new source signal parts in each speaker $L_1$ and $L'_2$ are to be merged.

Hence, the direct sound renderer is configured to reallocate a direct sound component having a determined direction of arrival $S_2$ from the segment $\{L_2, L_3\}$ in the original loudspeaker setup to a neighboring segment $\{L_1, L'_2\}$ in the playback loudspeaker setup if a boundary between the segment and the neighboring segment trespasses the determined direction of arrival $S_2$ when passing from the original loudspeaker setup to the playback loudspeaker setup. Furthermore, the direct sound renderer may be configured to reallocate the direct sound component having the determined direction of arrival from at least one loudspeaker of the original segment $\{L_2, L_3\}$ to at least one loudspeaker in the neighboring segment in the output setup $\{L_1, L'_2\}$. In particular, the direct renderer may be configured to reallocate the direct component of $S_2$ in $L_3$ assigned to segment $\{L_2, L_3\}$ in the input setup to the displaced loudspeaker $L'_2$ assigned to segment $\{L_1, L'_2\}$ in the playback setup and to reallocate the direct component of $S_2$ in $L_2$ assigned to segment $\{L_2, L_3\}$ in the input setup to $L_1$ assigned to segment $\{L_1, L'_2\}$ in the playback setup. Note that the action of reallocating may also involve an adjustment of the direct sound component, for example by performing a repanning with respect to a relative amplitude and/or a relative delay of the loudspeaker signals.

For the ambient signals in FIG. 6B a similar processing may be performed: The ambient signals in segment $\{L_2, L_3\}$ are adjusted by using one of the AERSs. For large displacements, additionally, a part of these ambient signals can be added to the segment $\{L_1, L'_2\}$ and adjusted by an AERS.

Within the combining stage 180 (FIG. 2), the actual speaker signals for the playback loudspeaker setup (output setup) are formed. This is done by adding up corresponding remapped and re-rendered direct and ambient signals of the respective left and right segment with respect to the speaker in between (The terms "left" and "right" loudspeaker hold for the two-dimensional case, i.e., all speakers are in the same plane, typically a horizontal plane). At the output of the combining stage 180, the signals for the original audio scene, but now rendered for a new loudspeaker setup (the playback loudspeaker setup) with M loudspeakers at positions $\hat{\theta}_s$ and $\hat{\phi}_s$, are emitted.

At this point, i.e. at the output of the combiner or combining stage 180, the novel system provides loudspeaker signals where all modifications with respect to the azimuth and elevation angle of the speakers in the output setup have been corrected. If a loudspeaker in the output setup was moved such that its distance to the listening point has changed to a new distance $\hat{\rho}_s$, the optional distance adjustment stage 190 may apply a correction factor and a delay to that channel to compensate for the change of distance. The output 4 of this stage results in the loudspeaker channels of the actual playback setup.

Another embodiment may use the invention to implement a moving sweet spot of the playback loudspeaker setup. For this, in a first step, the algorithm or apparatus has to determine the listener's position. This can easily be done by using a tracking technique/device to determine the current position of the listener. Then, the apparatus recomputes the positions of the loudspeakers with respect to the listener's position, which means a new coordinate system with the listener in the origin. This is the equivalent of having a fixed listener and moving loudspeakers. The algorithm then computes the signals optimally for this new setup.

Figure 7:
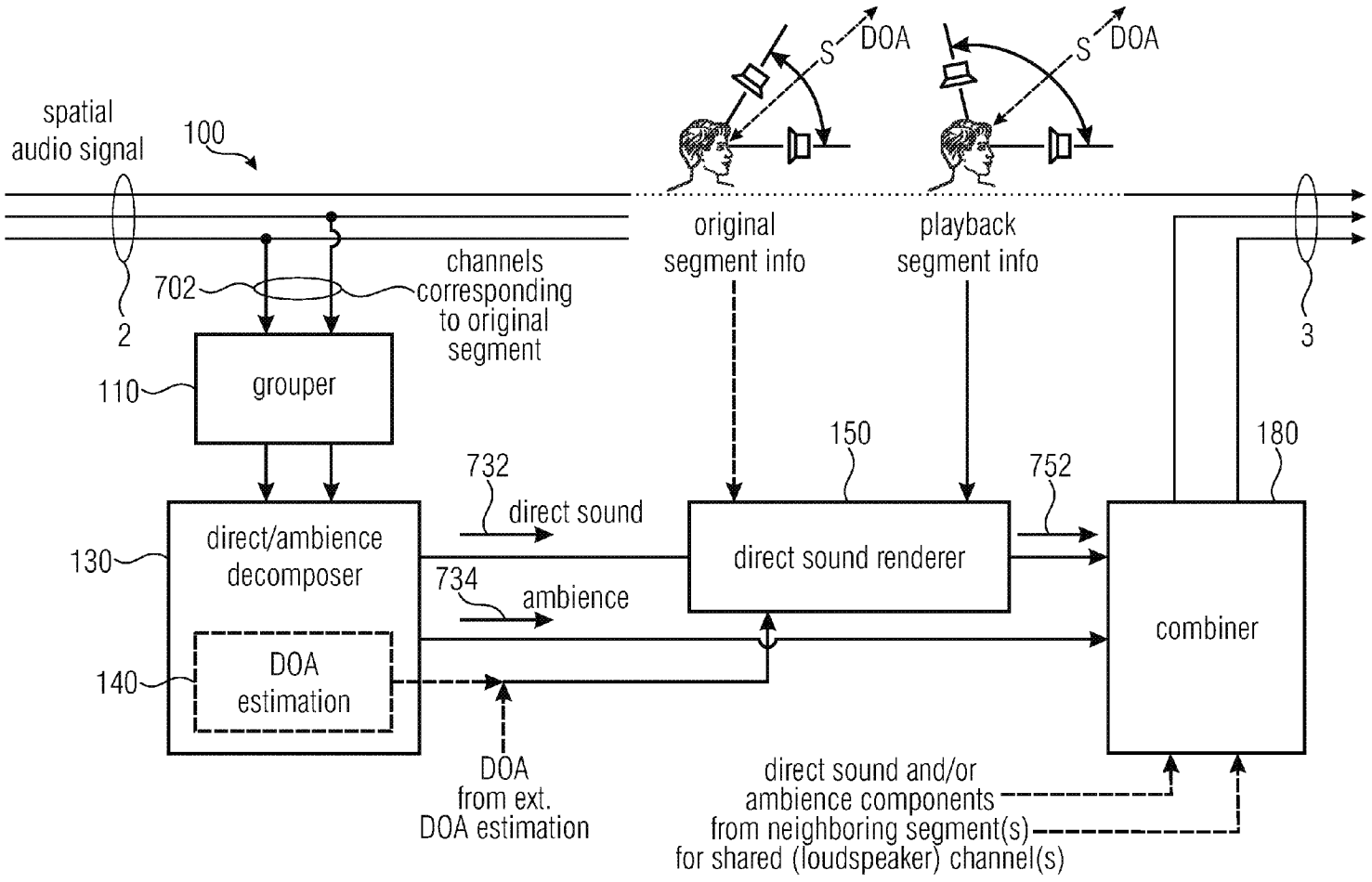
FIG. 7 shows a schematic block diagram of an apparatus for adjusting a spatial audio signal.

FIG. 7 shows a schematic block diagram of an apparatus 100 for adjusting a spatial audio signal 2 to a playback loudspeaker setup according to at least one embodiment. The apparatus 100 comprises a grouper 110 configured to group at least two channel signals 702 into a segment. The apparatus 100 further comprises a direct-ambience decomposer 130 configured to decompose the at least two channel signals 702 in the segment to at least one direct sound component 732 and at least one ambience component 734. The direct-ambience decomposer 130 may optionally comprise a direction-of-arrival estimator 140 configured to estimate the DOA(s) of the at least one direct sound component 732. As an alternative, the DOA(s) may be provided from an external DOA estimation or as meta information/side information accompanying the spatial audio signal 2.

A direct sound renderer 150 is configured to receive a playback loudspeaker setup information for at least one playback segment associated with the segment and to adjust the at least one direct sound component 732 using the playback loudspeaker setup information for the segment so that a perceived direction of arrival of the at least one direct sound component in the playback loudspeaker setup is substantially identical to the direction of arrival of the segment. At least the rendering performed by the direct sound renderer 150 results the perceived direction of arrival being closer to the direction of arrival of the at least one direct sound component compared to a situation in which no adjusting has taken place. In an inset in FIG. 7, an original segment of the original loudspeaker setup and a corresponding playback segment of the playback loudspeaker setup is schematically illustrated. Typically, the original loudspeaker setup is known or standardized so that information about the original loudspeaker setup does not necessarily have to be provided to the direct sound renderer 150, but the direct sound renderer has this information already available. Nevertheless, the direct sound renderer may be configured to receive original loudspeaker setup information. In this manner, the direct sound renderer 150 may be configured to support spatial audio signals as input that have been recorded or created for different original loudspeaker setups, such as 5.1, 7.1, 10.2, or even 22.2 setups.

The apparatus 100 further comprises a combiner 180 configured to combine adjusted direct sound components 752 and the ambience components 734 or modified ambience components to obtain loudspeaker signals for at least two loudspeakers of the playback loudspeaker setup. The loudspeaker signals for the at least two loudspeakers of the playback loudspeaker setup are part of the adjusted spatial audio signal 3 that may be output by the apparatus 100. As mentioned above, a distance adjustment may be performed on the DOA-adjusted spatial audio signal to obtain the DOA-and-distance-adjusted spatial audio signal 4 (see FIG. 2). The combiner 180 may also be configured to combine the adjusted direct sound component 752 and the ambience component 734 with direct sound and/or ambience components from one or more neighboring segment(s) that share the loudspeaker with the contemplated segment.

Figure 8:
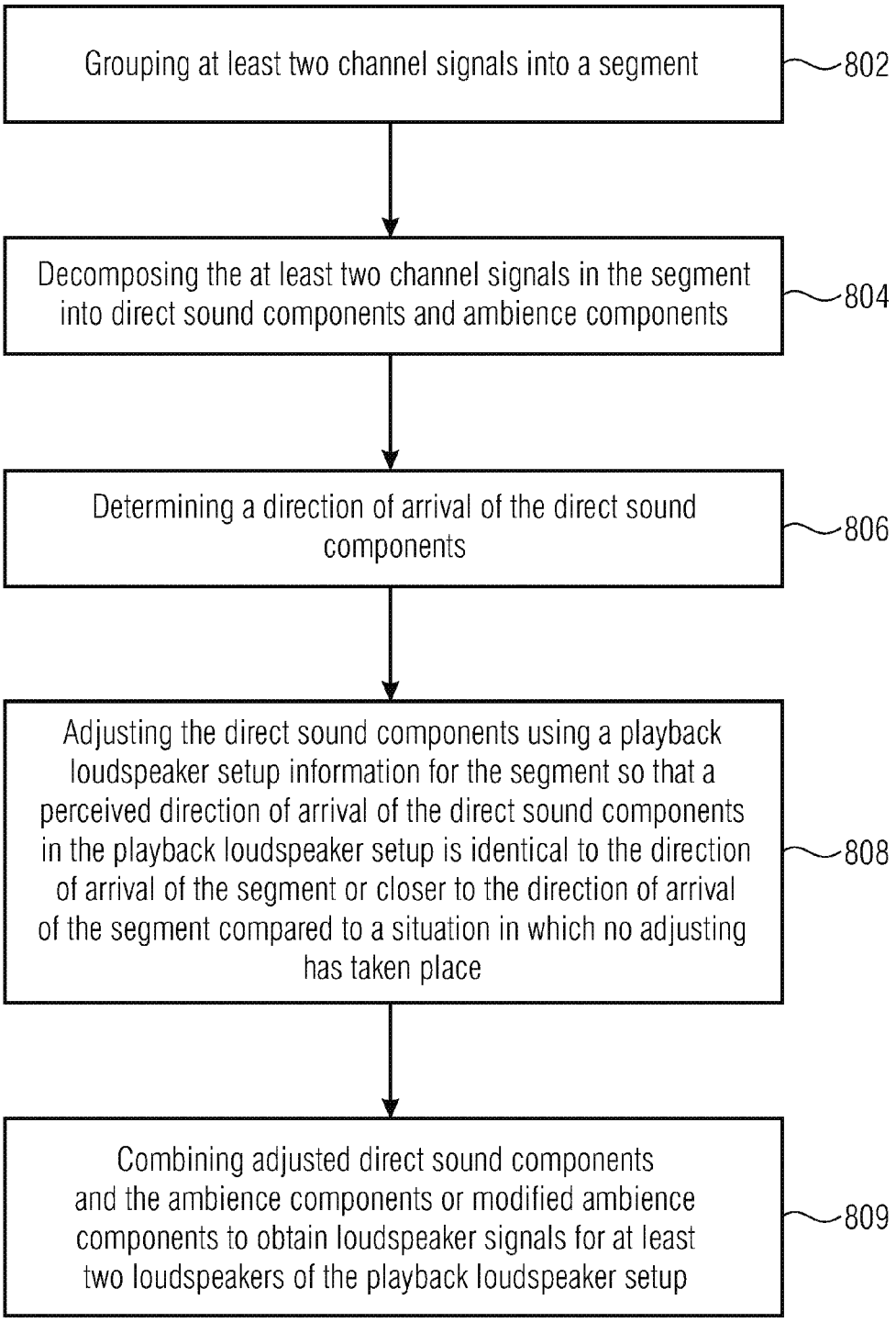
FIG. 8 shows a schematic flow diagram of a method for adjusting a spatial audio signal.

FIG. 8 shows a schematic flow diagram of a method for adjusting a spatial audio signal to a playback loudspeaker setup that differs from an original loudspeaker setup intended for presenting the audio content conveyed by the spatial audio signal. The method comprises a step 802 of grouping at least two channel signals into a segment. The segment is typically one of the segments of the original loudspeaker setup. The at least two channel signals in the segment are decomposed into direct sound components and ambience components during a step 804. The method further comprises a step 806 for determining a direction of arrival of the direct sound components. The direct sound components are adjusted in a step 808 using a playback loudspeaker setup information for the segment so that a perceived direction of arrival of the direct sound components in the playback loudspeaker setup is identical to the direction of arrival of the segment or closer to the direction of arrival of the segment compared to a situation in which no adjusting has taken place. The method also comprises a step 809 for combining adjusted direct sound components and the ambience components or modified ambience components to obtain loudspeaker signals for at least two loudspeakers of the playback loudspeaker setup.

The proposed adjustment of a spatial audio signal to an encountered playback loudspeaker setup may relate to one or more of the following aspects:

- Group neighboring loudspeaker channels of original setup into segments
- Segment-based Direct/Ambience-Decomposition
- Several different Direct/Ambience-Decomposition and position extraction algorithms selectable
- Remapping of direct components such that perceived direction substantially remains the same
- Remapping of ambience components such that perceived envelopment substantially remains the same
- Speaker distance correction by applying a scaling factor and/or a delay
- Several panning algorithms selectable
- Independent remapping of direct and ambience components
- Time and frequency selective processing
- Overall waveform-preserving processing for all loudspeaker channels if output setup matches the input setup
- Channel-wise waveform-preserving for each loudspeaker where the segments to which the speaker contributes are unmodified with respect to input and output setup
- Special Cases:
  - "Inverse panning" and panning of a given input scene with a different panning algorithm
  - Per segment, at least one direct and ambience signal.
  - In segments consisting of two speakers: maximal two direct and two ambient signals. The number of used direct and ambience signals is independent of each other, but depends on the intended spatial target quality of the rendered direct and ambience signals.

Segment-based Down/Upmix

Ambience Remapping is performed according to Ambience Energy Remapping Schemes (AERSs), comprising of:

Constant ambience energy

Constant ambience (angular) density

At least some embodiments of the present invention are configured to perform a channel-based flexible sound scene conversion, which comprises a decomposition of the original speaker channels into direct and ambient signal parts of a (phantom) source within and according to every previously built segment. The directions-of-arrival (DOAs) of every direct source are estimated and fed, together with the direct and ambient signals, into a renderer and distance adjuster, where—according to the playback loudspeaker setup and the DOAs—the original speaker signals are modified to preserve the actual audio scene. The proposed method and apparatus function waveform-preserving and are even able to handle output setups with an increased or decreased number of loudspeaker channels than available in the input setup.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

The described embodiments are merely illustrative for the principles of the present invention. It is understood that modifications and variations of the arrangements and the details described herein will be apparent to others skilled in the art. It is the intent, therefore, to be limited only by the scope of the appending patent claims and not by the specific details presented by way of description and explanation of the embodiments herein.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus like, for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, an EPROM, an EEPROM or a FLASH memory, having electronically readable control signal stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is therefore a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is therefore a data stream or a sequence of signals representing the computer program for performing one of the methods described herein. The data stream or the sequence of signals may, for example, be configured to be transferred via a data communication connection, for example via the internet.

A further embodiment comprises a processing means, for example a computer or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may operate with a microprocessor in order to perform one of the methods described herein. Generally, the methods are advantageously performed by any hardware apparatus.

Embodiments of the present invention may be based on techniques for Direct-Ambience Decomposition. The direct-ambience decomposition can be carried out either based on a signal model or on a physical model.

The idea behind a direct-ambience decomposition based on a signal model is the assumption that a direct perceived and locatable sound consists of either one single or more coherent or correlated signals. Whereas the ambient, thus unlocatable sound corresponds to the uncorrelated signal parts. The transition between direct and ambience is seamless and depends on correlation between the signals. Further information about direct-ambience decomposition can be found: in C. Faller, "Multiple-Loudspeaker Playback of Stereo Signals," *J. Audio Eng. Soc*, vol. 54, no. 11, pp. 1051-1064, 2006; in J. S. Usher and J. Benesty, "Enhancement of Spatial Sound Quality: A New Reverberation-Extraction Audio Upmixer," *IEEE Transactions on Audio, Speech, and Language Processing*, vol. 15, no. 7, pp. 2141-2150, 2007; and in M. Goodwin and J.-M. Jot, "Primary-Ambient Signal Decomposition and Vector-Based Localization for Spatial Audio Coding and Enhancement,"

*IEEE International Conference on Acoustics, Speech and Signal Processing* (*ICASSP*), vol. 1, 2007, pp. I-9-I-12.

Directional Audio Coding (DirAC) is one possible method to decompose the signals into direct and diffuse signal energies based on a physical model. Here, the sound field properties for sound pressure and sound (particle) velocity in the listening point are captured either by a real or virtual B-format recording. Afterwards, with the assumption the sound field only consists of one single plane wave and the rest being diffuse energy, the signal can be decomposed in direct and diffuse signal parts. From direct parts, the so-called Direction Of Arrivals (DOAs) can be calculated. With the knowledge of the actual loudspeaker positions, the direct signal parts can be repanned by using dedicated panning laws (see e.g., V. Pulkki, "Virtual Sound Source Positioning Using Vector Base Amplitude Panning," *J. Audio Eng. Soc*, vol. 45, no. 6, pp. 456-466, 1997.) to preserve their global position in the rendering stage. Finally, the decorrelated ambient and the panned direct signal parts are combined again, resulting in the loudspeaker signals (as described in, e.g., V. Pulkki, "Spatial Sound Reproduction with Directional Audio Coding," *J. Audio Eng. Soc*, vol. 55, no. 6, pp. 503-516, 2007; or V. Pulkki and J. Herre, "Method and Apparatus for Conversion Between Multi-Channel Audio Formats," US Patent Application Publication No. US 2008/0232616 A1, 2008).

Another approach is described by J. Thompson, B. Smith, A. Warner, and J.-M. Jot in "Direct-Diffuse Decomposition of Multichannel Signals Using a System of Pairwise Correlations" (presented at 133*rd Convention of the AES* 2012, October 2012), where direct and diffuse energies of a multi-channel signal are estimated by a system of pairwise correlations. The signal model used here allows to detect one direct and diffuse signal within each channel including the direct signal's phase shift across the channels. One assumption of this approach is that the direct signals across all channels are correlated, i.e. they are all representing the same source signal. The processing is carried out in frequency domain and for each frequency band.

A possible implementation of direct-diffuse decomposition (or direct-ambience decomposition) is now described in connection with stereo signals as an example. Other techniques for direct-diffuse decomposition are also possible, and also signals other than stereo signals may be subject to direct-diffuse decomposition. Typically, stereo signals are recorded or mixed such that for each source the signal goes coherently into the left and right signal channel with specific directional cues (level difference, time difference) and reflected/reverberated independent signals into the channels determining auditory object width and listener envelopment cues. Single source stereo signals may be modeled by a signal s that mimics the direct sound from a direction determined by a factor a, and by independent signals $n_1$ and $n_2$ corresponding to lateral reflections. The stereo signal pair $x_1$, $x_2$ is related to these signals s, $n_1$, and $n_2$ by the following equations:

$$x_1(k)=s(k)+n_1(k)$$

$$x_2(k)=a\cdot s(k)+n_2(k),$$

wherein k is a time index. Accordingly, the direct sound signal s appears in both stereo signals $x_1$ and $x_2$, however typically with different amplitude. The described decomposition may be carried out in a number of frequency bands and adaptively in time in order to obtain a decomposition which is not only valid in one auditory object scenario, but also for nonstationary sound scenes with multiple concurrently active sources. Accordingly, the above equations may be written for a particular time index k and a particular frequency sub-band m as:

$$x_{1,m}(k)=s_m(k)+n_{1,m}(k)$$

$$x_{2,m}(k)=A_b s_m(k)+n_{2,m}(k),$$

where m is the sub-band index, k is the time index, $A_b$ the amplitude factor for signal $s_m$ for a certain parameter band b that may comprise one or more sub-bands of the sub-band signals. In each time-frequency tile with indices m and k the signals $s_m$, $n_{1,m}$, $n_{2,m}$ and factor $A_b$ are estimated independently. A perceptually motivated sub-band decomposition may be used. This decomposition may be based on the fast fourier transform, quadrature mirror filterbank, or other filterbank. For each parameter band b, the signals $s_m$, $n_{1,m}$, $n_{2,m}$ and $A_b$ are estimated based on segments with a certain temporal length (e.g., approx. 20 ms). Given the stereo sub-band signal pair $x_{1,m}$ and $x_{2,m}$, the goal is to estimate $s_m$, $n_{1,m}$, $n_{2,m}$ and $A_b$ in each parameter band. An analysis of the powers and cross-correlation of the stereo signal pair may be performed to this end. The variable $p_{x1,b}$ denotes a short-time estimate of the power of $x_{1,m}$ in parameter band b. The powers of $n_{1,m}$ and $n_{2,m}$ may be assumed to be the same, i.e. it is assumed that the amount of lateral independent sound is the same for the left and right signals: $p_{n1,b}=p_{n1,b}=p_{n,b}$.

The power ($p_{x1,b}$, $p_{x2,b}$) and the normalized cross-correlation $p_{x1\ x2,b}$ for parameter band b may be computed using the sub-band representation of the stereo signal. The variables $A_b$, $p_{s,b}$, and $p_{n,b}$ are subsequently estimated as a function of the estimated $p_{x1,b}$, $p_{x2,b}$ and $p_{x1\ x2,b}$. Three equations relating the known and unknown variables are:

$$p_{x1,b} = p_{s,b} + p_{n,b}$$

$$p_{x_2,b} = A_b^2 p_{s,b} + p_{n,b}$$

$$\rho_{x_1 x_2,b} = \frac{A_b p_{s,b}}{\sqrt{p_{x_1,b} p_{x_2,b}}}$$

These equations solved for $A_b$, $p_{s,b}$, and $p_{n,b}$ yield:

$$A_b = \frac{B_b}{2C_b}$$

$$p_{s,b} = \frac{2C_b^2}{B_b}$$

$$p_{n,b} = p_{s_1,b} - \frac{2C_b^2}{B_b}$$

with $$B_b = p_{x_2,b} - p_{x_1,b} + \sqrt{(p_{x_1,b} - p_{x_2,b})^2 + 4p_{x_1,b}p_{x_2,b}\rho_{x_1 x_2,b}^2}$$

$$C_b = \rho_{x_1 x_2,b}\sqrt{p_{x_1,b}p_{x_2,b}}$$

Next, the least squares estimates of $s_m$, $n_{1,m}$ and $n_{2,m}$ are computed as a function of $A_b$, $p_{s,b}$, and $p_{n,b}$. For each parameter band b and each independent signal frame, the signal $s_m$ is estimated as $$\hat{s}_m(k) = w_{1,b}x_{1,m}(k) + w_{2,b}x_{1,m}(k)$$

$$= w_{1,b}(s_m(k) + n_{1,m}(k)) + w_{2b}(A_b s_m(k) + n_{2,m}(k))$$

where $w_{1,b}$ and $w_{2,b}$ are real-valued weights. The weights $w_{1,b}$ and $w_{2,b}$ are optimal in a least mean-square sense when an error signal E is orthogonal to $x_{1,m}$ and $x_{2,m}$ in parameter band b. The signals $n_{1,m}$ and $n_{2,m}$ may be estimated in a similar manner. For example, $n_{1,m}$ may be estimated as $$\begin{aligned}\hat{n}_{1,m}(k) &= w_{3,b}x_{1,m}(k) + w_{4,b}x_{2,m}(k)\\ &= w_{3,b}(s_m(k) + n_{1,m}(k)) + w_{4,b}(A_b s_m(k) + n_{2,m}(k))\end{aligned}$$

Post-scaling may then be performed on the initial least-square estimates $\hat{s}_m$, $\hat{n}_{1,m}$, and $\hat{n}_{2,m}$ in order to match the power of the estimates in each parameter band to $p_{s,b}$ and $p_{n,b}$. A more detailed description of the least mean-square method may be found in chapter 10.3 of the textbook "Spatial Audio Processing" by J. Breebart and C. Faller, which is incorporated herein by reference. One or more of these aspects may employed in connection with or in the context of the proposed adjustment of a spatial audio signal.

Embodiments of the present invention may relate to or employ one or more Multi-Channel Panners. Multi-Channel Panners are tools which enable the sound engineer to place a virtual or phantom source within an artificial audio scene. This can be achieved in several manners. Following a dedicated gain function or panning law, a phantom source can be placed within an audio scene by applying an amplitude weighting or delay or both to the source signal. Further information about Multi-Channel Panners can be found in the U.S. Patent Application Publication No. US 2012/0170758 A1 "Multi-Channel Sound Panner" by A. Eppolito, in V. Pulkki, "Virtual Sound Source Positioning Using Vector Base Amplitude Panning," *J. Audio Eng. Soc*, vol. 45, no. 6, pp. 456-466, 1997; and in J. Blauert, "Spatial hearing: The psychophysics of human sound localization", section 2.2.2, 3*rd ed. Cambridge and Mass: MIT Press,* 2001. For example, a panner can be employed that can support an arbitrary number of input channels and changes to configurations to the output sound space. For example, the panner may seamlessly handle changes in the number of input channels. Also, the panner may support changes to the number and positions of speakers in the output space. The panner may allow continuous control of attenuation and collapsing. The panner may keep source channels on the periphery of the sound space when collapsing channels. The panner may allow control over the path by which sources collapse. These aspects may be achieved by a method that comprises receiving input requesting re-balancing of a plurality of channels of source audio in a sound space having a plurality of speakers, wherein the plurality of channels of source audio are initially described by an initial position in the sound space and an initial amplitude, and wherein the positions and the amplitudes of the channels defines a balance of the channels in the sound space. Based on the input, a new position in the sound space is determined for at least one of the source channels. Based on the input, a modification to the amplitude of at least one of the source channels is determined, wherein the new position and the modification to the amplitude achieves the re-balancing. In response to determining that the input indicates that a particular speaker of the plurality of speakers is to be disabled, sound that was to originate from the particular speaker may be automatically transferred to other speakers adjacent to the particular speaker. The method is performed by one or more computing devices. One or more of these aspects may employed in connection with or in the context of the proposed adjustment of a spatial audio signal.

Some embodiments of the present invention may relate to or employ concepts for changing existing audio scenes. A system to compose or even change an existing audio scene was introduced by IOSONO (as described in German Patent Application No. DE 10 2010 030 534 A1, "Vorrichtung zum Verändern einer Audio-Szene and Vorrichtung zum Erzeugen einer Richtungsfunktion"). It uses an object-based source representation plus additional meta data, combined with a directional function to position the source within the audio scene. If an already existing audio scene, without audio object and meta data, is fed into this system, the audio objects, directions and directional functions have to first be determined from that audio scene. One or more of these aspects may employed in connection with or in the context of the proposed adjustment of a spatial audio signal.

Some embodiments of the present invention may relate to or employ a Channel Conversion and Positioning Correction. Most systems which aim at correcting a faulty loudspeaker positioning or deviation in playback channels try to preserve the physical properties of the sound field. For a downmix scenario, a possible approach could be to model omitted loudspeakers as virtual speakers by panning and by this means preserve sound pressure and particle velocity at the listening point (as described in A. Ando, "Conversion of Multi-channel Sound Signal Maintaining Physical Properties of Sound in Reproduced Sound Field", *IEEE Transactions on Audio, Speech, and Language Processing*, vol. 19, no. 6, pp. 1467-1475, 2011). Another method would be to calculate the loudspeaker signals in the target setup to restore the original sound field. This is done by transitioning the original loudspeaker signals into a sound field representation and rendering the new loudspeaker signals from that representation (as described in A. Laborie, R. Bruno, and S. Montoya, "Reproducing Multichannel Sound on any Speaker Layout", in 118*th Convention of the AES,* 2005).

According to Ando, a conversion of a multichannel sound signal is possible by converting the signal of the original multichannel sound system into that of an alternative system with a different number of channels while maintaining the physical properties of sound at the listening point in the reproduced sound field. Such a conversion problem can be described by the underdetermined linear equation. To obtain an analytical solution to the equation, the method partitions the sound field of the alternative system on the basis of the positions of three loudspeakers and solves the "local solution" in each subfield. As a result, the alternative system localizes each channel signal of the original sound system at the corresponding loudspeaker position as a phantom source. The composition of the local solutions introduces the "global solution," that is, the analytical solution to the conversion problem. Experiments were performed with 22-channel signals of a 22.2 multichannel sound system without the two low-frequency effect channels converted into 10-, 8-, and 6-channel signals by the method. Subjective evaluations showed that the proposed method could reproduce the spatial impression of the original 22-channel sound with eight loudspeakers. One or more of these aspects may employed in connection with or in the context of the proposed adjustment of a spatial audio signal.

Spatial Audio Scene Coding (SASC) is an example for a non-physical motivated system (M. Goodwin and J.-M. Jot, "Spatial Audio Scene Coding," in 125*th Convention of the AES,* 2008). It performs a Principal Component Analysis (PCA) to decompose the multi-channel input signals into their primary and ambience components under some inter-channel correlation constraints (M. Goodwin and J.-M. Jot, "Primary-Ambient Signal Decomposition and Vector-Based Localization for Spatial Audio Coding and Enhancement", in *IEEE International Conference on Acoustics, Speech and Signal Processing* (*ICASSP*), vol. 1, 2007, pp. I-9-I-12.). The primary component is identified here as the eigenvector of the input channel correlation matrix with the largest eigenvalue. Afterwards, a primary and ambience localization analysis is performed, where a direct and ambient localization vector are determined. The rendering of the output signals is done by generating a format matrix which contains the unit vectors pointing to the spatial direction of the output channels. Based on that format matrix, a set of null weights is derived, so that the weight vector is in the null space of the format matrix. Directional components are generated by pairwise panning between these vectors and non-directional components are generated by using the whole set of vectors in the format matrix. The final output signals are generated by interpolating between the directional and non-directional panned signal parts. In this Spatial Audio Scene Coding (SASC) framework, the central idea is to represent an input audio scene in a way that is independent of any assumed or intended reproduction format. This format-agnostic parameterization enables optimal reproduction over any given playback system as well as flexible scene modification. The signal analysis and synthesis tools needed for SASC are described, including a presentation of new approaches for multichannel primary-ambient decomposition. Applications of SASC to spatial audio coding, upmix, phase-amplitude matrix decoding, multichannel format conversion, and binaural reproduction may employed in connection with or in the context of the proposed adjustment of a spatial audio signal. One or more of these aspects may employed in connection with or in the context of the proposed adjustment of a spatial audio signal.

Some embodiments of the present invention may relate to or employ upmix-techniques. In general, upmix-techniques could be classified in two major categories: The kind of methods which feed the surround channels with synthesized or extracted ambience from the existing input channels (see e.g. J. S. Usher and J. Benesty, "Enhancement of Spatial Sound Quality: A New Reverberation-Extraction Audio Upmixer", *IEEE Transactions on Audio, Speech, and Language Processing*, vol. 15, no. 7, pp. 2141-2150, 2007; C. Faller, "Multiple-Loudspeaker Playback of Stereo Signals", *J. Audio Eng. Soc*, vol. 54, no. 11, pp. 1051-1064, 2006; C. Avendano and J.-M. Jot, "Ambience extraction and synthesis from stereo signals for multi-channel audio up-mix", in *Acoustics, Speech, and Signal Processing* (*ICASSP*), 2002 IEEE International Conference on, vol. 2, 2002, pp. 11-1957-II-1960; and R. Irwan and R. M. Aarts, "Two-to-Five Channel Sound Processing", *J. Audio Eng. Soc*, vol. 50, no. 11, pp. 914-926, 2002), and those which create the driving signals for the additional channels by matrixing the existing ones (see e.g. R. Dressler. (5 Aug. 2004) Dolby Surround Pro Logic II Decoder Principles of Operation. [Online].

Available: http://www.dolby.com/uploadedFiles/Assets/US/Doc/Professional/209 Dolby_Surround_Pro_Logic_II_Decoder_Principles_of_Operation.pdf). A special case is the method proposed in US Patent Application Publication No. US2010/0296672 A1 "Two-to-Three Channel Upmix For Center Channel Derivation" by E. Vickers, where instead of an ambience extraction a spatial decomposition is carried out. Amongst others, ambience generating methods can comprise of applying artificial reverberation, computing the difference of left and right signals, applying small delays for surround channels and correlation based signal analyses. Examples for matrixing techniques are linear matrix converters and matrix steering methods. A brief overview of these methods is given by C. Avendano and J.-M. Jot in "Frequency Domain Techniques for Stereo to Multichannel Upmix," in 22*nd International Conference of the AES on Virtual, Synthetic and Entertainment Audio,* 2002 and by the same authors in "Ambience extraction and synthesis from stereo signals for multi-channel audio up-mix" in *Acoustics, Speech, and Signal Processing* (*ICASSP*), 2002 IEEE International Conference on, vol. 2, 2002, pp. II-1957-II-1960. One or more of these aspects may employed in connection with or in the context of the proposed adjustment of a spatial audio signal.

Ambience extraction and synthesis from stereo signals for multi-channel audio up-mix can be achieved by a frequency-domain technique to identify and extract the ambience information in stereo audio signals. The method is based on the computation of an inter-channel coherence index and a non-linear mapping function that allow us to determine time-frequency regions that consist mostly of ambience components in the two-channel signal. Ambience signals are then synthesized and used to feed the surround channels of a multi-channel playback system. Simulation results demonstrate the effectiveness of the technique in extracting ambience information and up-mix tests on real audio reveal the various advantages and disadvantages of the system compared to previous up-mix strategies. One or more of these aspects may employed in connection with or in the context of the proposed adjustment of a spatial audio signal.

Frequency domain techniques for stereo to multichannel upmix may also be employed in connection with or in the context of adjusting a spatial audio signal to a playback loudspeaker setup. Several upmixing techniques for generating multichannel audio from stereo recordings are available. The techniques use a common analysis framework based on the comparison between the Short-Time Fourier Transforms of the left and right stereo signals. An inter-channel coherence measure is used to identify time-frequency regions consisting mostly of ambience components, which can then be weighed via a non-linear mapping function, and extracted to synthesize ambience signals. A similarity measure is used to identify the panning coefficients of the various sources in the mix in the time-frequency plane, and different mapping functions are applied to unmix (extract) one or more sources, and/or to re-pan the signals into an arbitrary number of channels. One possible application of the various techniques relates to the design of a two-to-five channel upmix system. One or more of these aspects may employed in connection with or in the context of the proposed adjustment of a spatial audio signal.

A surround decoder may be adept at bringing out the hidden spatial cues in conventional music recordings in a natural, convincing way. The listener is drawn into a three-dimensional space rather than hearing a flat, two-dimensional presentation. This not only helps develop a more involving soundfield, but also solves the narrow "sweet spot" problem of conventional stereo reproduction. In some logic decoders the control circuit is looking at the relative level and phase between the input signals. This information is sent to the variable output matrix stage to adjust VCAs controlling the level of antiphase signals. The antiphase signals cancel the unwanted crosstalk signals, resulting in improved channel separation. This is called a feedforward design. This concept may be extended by looking at the same input signals and performing closed loop control so that they match their levels. These matched audio signals are sent directly to the matrix stages to derive the various output channels. Because the same audio signals that feed the output matrix are themselves used to control the servo loop, it is called a feedback logic design. The concept of feedback control may improve accuracy and optimize dynamic characteristics. Incorporating global feedback around the logic steering process brings similar benefits in steering accuracy and dynamic behavior. One or more of these aspects may employed in connection with or in the context of the proposed adjustment of a spatial audio signal.

In connection with multiple loudspeaker playback, a perceptually motivated spatial decomposition for two-channel stereo audio signals, capturing the information about the virtual sound stage may be used. The spatial decomposition allows resynthesizing audio signals for playback over sound systems other than two-channel stereo. With the use of more front loudspeakers the width of the virtual sound stage can be increased beyond ±30° and the sweet-spot region is extended. Optionally, lateral independent sound components can be played back separately over loudspeakers on the sides of a listener to increase listener envelopment. The spatial decomposition can be used with surround sound and wave-field synthesis-based audio systems. One or more of these aspects may employed in connection with or in the context of the proposed adjustment of a spatial audio signal.

Primary-ambient signal decomposition and vector-based localization for spatial audio coding and enhancement address the growing commercial need to store and distribute multi-channel audio and to render content optimally on arbitrary reproduction systems. A spatial analysis-synthesis scheme may apply principal component analysis to an STFT-domain (short time frequency transformation domain) representation of the original audio to separate it into primary and ambient components, which are then respectively analyzed for cues that describe the spatial percept of the audio scene on a per-tile basis; these cues may be used by the synthesis to render the audio appropriately on the available playback system. This framework can be tailored for robust spatial audio coding, or it can be applied directly to enhancement scenarios where there are no rate constraints on the intermediate spatial data and audio representation.

Regarding spaciousness and envelopment in musical acoustics, conventional wisdom holds that spaciousness and envelopment are caused by lateral sound energy in rooms, and it is primarily the early arriving lateral energy that is most responsible. However by definition small rooms are not spacious, yet they can be loaded with early lateral reflections. Therefore, the perceptual mechanisms for spaciousness and envelopment may have an influence on the adjustment of a spatial audio signal. The perceptions are found to be related most commonly to the lateral (diffuse) energy in halls at the ends of notes (the background reverberation) and less often, but importantly, to the properties of the sound field as the notes are held. A measure for spaciousness, called lateral early decay time (LEDT), is suggested. One or more of these aspects may employed in connection with or in the context of the proposed adjustment of a spatial audio signal.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for adapting a spatial audio signal for an original loudspeaker setup to a playback loudspeaker setup that differs from the original loudspeaker setup, wherein the spatial audio signal comprises a plurality of channel signals, each channel signal being a loudspeaker channel corresponding to a loudspeaker of the original loudspeaker setup, the apparatus comprising:

a grouper configured to group the plurality of channel signals into a plurality of original segments, wherein at least two neighboring channel signals are grouped into an original segment, and wherein a loudspeaker is assigned to a first original segment and to a second original segment;

a direct-ambience decomposer configured to decompose the at least two channel signals in the first original segment into at least one direct sound component and at least one ambience component, and to determine a direction of arrival of the at least one direct sound component for the first original segment, and to decompose the at least two channel signals in the second original segment into at least one direct sound component and at least one ambience component for the second original segment, and to determine a direction of arrival of the at least one direct sound component for the second original segment;

a direct sound renderer configured to receive a playback loudspeaker setup information for a first playback segment associated with the first original segment and to adjust the at least one direct sound component of the first original segment using the playback loudspeaker setup information for the first playback segment to obtain at least one adjusted direct sound component so that a perceived direction of arrival of the at least one direct sound component in the playback loudspeaker setup is identical to the direction of arrival of the first original segment or closer to the direction of arrival of the at least one direct sound component of the first original segment compared to a situation in which no adjusting of the at least one direct sound component has taken place, and configured to receive a playback loudspeaker setup information for a second playback segment associated with the second original segment and to adjust the at least one direct sound component of the second original segment using the playback loudspeaker setup information for the second playback segment to obtain at least one further adjusted direct sound component so that a perceived direction of arrival of the at least one direct sound component in the playback loudspeaker setup is identical to the direction of arrival of the second original segment or closer to the direction of arrival of the at least one direct sound component of the second original segment compared to a situation in which no adjusting of the at least one direct sound component has taken place; and a combiner configured to combine the at least one adjusted direct sound component and the ambience components or modified ambience components of a first playback segment and the at least one further adjusted direct sound components and the ambience components or modified ambience components of a second playback segment.

2. The apparatus according to claim 1, wherein the playback loudspeaker setup comprises an additional loudspeaker within the first or second original segment so that the first or second original segment of the original loudspeaker setup corresponds to two or more segments of the playback loudspeaker segment;

wherein the direct sound renderer is configured to generate the adjusted direct sound components for the at least two loudspeakers and the additional loudspeaker of the playback loudspeaker setup.

3. The apparatus according to claim 1, wherein the playback loudspeaker setup lacks a loudspeaker compared to the original loudspeaker setup so that a left or right original segment and a neighboring left or right original segment of the original loudspeaker setup are merged to one merged segment of the playback loudspeaker setup;

wherein the direct sound renderer is configured to distribute adjusted direct sound components of a channel corresponding to the loudspeaker that lacks in the playback loudspeaker setup to at least two remaining loudspeakers of the merged segment of the playback loudspeaker setup.

4. The apparatus according to claim 1, wherein the direct sound renderer is configured to reallocate a direct sound component comprising a determined direction of arrival from a left or right original segment of the original loudspeaker setup to a neighboring segment of the playback loudspeaker setup if a boundary between the left or right original segment and the neighboring segment trespasses the determined direction of arrival when passing from the original loudspeaker setup to the playback loudspeaker setup.

5. The apparatus according to claim 4, wherein the direct sound renderer is further configured to reallocate the direct sound component comprising the determined direction of arrival from at least one first loudspeaker to at least one second loudspeaker, the at least one first loudspeaker being assigned to the left or right original segment in the original loudspeaker setup but not to the neighboring segment in the playback loudspeaker setup and the at least one second loudspeaker being assigned to the neighboring segment in the playback loudspeaker setup.

6. The apparatus according to claim 1, wherein the direct sound renderer is configured to perform a panning of the at least one direct sound component using the playback loudspeaker setup information and the perceived direction of arrival of the at least one direct sound component.

7. The apparatus according to claim 6, wherein the direct sound renderer is further configured to perform the panning of the at least one direct sound component comprising the determined direction of arrival using the playback loudspeaker setup information and the perceived direction of arrival of the at least one direct sound component by adjusting loudspeaker signals for loudspeakers in the left or right original segment to acquire adjusted loudspeaker signals for loudspeakers in a corresponding modified segment of the playback loudspeaker setup if at least one of the loudspeakers in the left or right original segment is displaced in the corresponding modified segment of the playback loudspeaker setup without trespassing the determined direction of arrival.

8. The apparatus according to claim 1, wherein the direct sound renderer is configured to generate loudspeaker-segment-specific direct sound components for at least two valid loudspeaker-segment pairs of the playback loudspeaker setup, the at least two valid loudspeaker-segment pairs referring to a specific loudspeaker and two neighboring segments in the playback loudspeaker setup; and wherein the combiner is configured to combine the loudspeaker-segment-specific direct sound components for the at least two valid loudspeaker-segment pairs referring to the specific loudspeaker to acquire one of the loudspeaker signals for at least two loudspeakers of the playback loudspeaker setup the at least two loudspeakers comprising the specific loudspeaker.

9. The apparatus according to claim 1, wherein the direct sound renderer is further configured to process the at least one direct sound component for a given segment of the playback loudspeaker setup and to thereby generate adjusted direct sound components for each loudspeaker assigned to the given segment.

10. The apparatus according to claim 1, further comprising an ambience renderer configured to receive the playback loudspeaker setup information for a left or right playback segment and to adjust the at least one ambience component using the playback loudspeaker setup information for the left or right playback segment so that a perceived envelopment of the at least one ambience component in the playback loudspeaker setup is identical to the envelopment of the left or right original segment or closer to the envelopment of the at least one ambience component of the left or right original segment compared to a situation in which no adjusting of the at least one ambience component has taken place.

11. The apparatus according to claim 1, wherein the grouper is further configured to scale the at least two channels as a function of how many original segments a channel of the at least two channels is assigned to.

12. The apparatus according to claim 1, further comprising a distance adjuster configured to adjust at least one of an amplitude and a delay of at least one of the loudspeaker signals for the at least two loudspeakers of the playback loudspeaker setup using a distance information relative to a distance between a listener and a certain loudspeaker in the playback loudspeaker setup.

13. The apparatus according to claim 1, further comprising a listener tracker configured to determine a current position of a listener with respect to the playback loudspeaker setup, and to determine the playback loudspeaker setup information using the current position of the listener.

14. The apparatus according to claim 1, further comprising a time-frequency transformer configured to transform the spatial audio signal from a time domain representation to a frequency domain representation or to a time-frequency domain representation, wherein the direct-ambience decomposer and the direct sound renderer are configured to process the frequency domain representation or the time-frequency domain representation.

15. A method for adapting a spatial audio signal for an original loudspeaker setup to a playback loudspeaker setup that differs from the original loudspeaker setup, wherein the spatial audio signal comprises a plurality of channels, each channel signal being a loudspeaker channel corresponding to a loudspeaker of the original loudspeaker setup, the method comprising:

grouping the plurality of channel signals into a plurality of original segments, wherein at least two neighboring channel signals are grouped into an original segment, and wherein a loudspeaker is assigned to a first original segment and to a second original segment;

decomposing the at least two channel signals in the first original segment into at least one direct sound component and at least one ambience component, and determining a direction of arrival of the at least one direct sound component for the first original segment, and decomposing the at least two channel signals in the second original segment into at least one direct sound component and at least one ambience component for the second original segment, and determining a direction of arrival of the at least one direct sound component for the second original segment;

adjusting the at least one direct sound component of the first original segment using the playback loudspeaker setup information for the first playback segment to obtain at least one adjusted direct sound component so that a perceived direction of arrival of the at least one direct sound component in the playback loudspeaker setup is identical to the direction of arrival of the first original segment or closer to the direction of arrival of the at least one direct sound component of the first original segment compared to a situation in which no adjusting of the at least one direct sound component has taken place, and adjusting the at least one direct sound component of the second original segment using the playback loudspeaker setup information for the second playback segment to obtain at least one further adjusted direct sound component so that a perceived direction of arrival of the at least one direct sound component in the playback loudspeaker setup is identical to the direction of arrival of the second original segment or closer to the direction of arrival of the at least one direct sound component of the second original segment compared to a situation in which no adjusting of the at least one direct sound component has taken place; and combining the at least one adjusted direct sound component and the ambience components or modified ambience components of a first playback segment and the at least one further adjusted direct sound components and the ambience components or modified ambience components of a second playback segment.

16. A non-transitory storage medium having stored thereon a computer program comprising a program code for performing, when being executed on a computer, a method for adapting a spatial audio signal for an original loudspeaker setup to a playback loudspeaker setup that differs from the original loudspeaker setup, wherein the spatial audio signal comprises a plurality of channels, each channel signal being a loudspeaker channel corresponding to a loudspeaker of the original loudspeaker setup, the method comprising:

grouping the plurality of channel signals into a plurality of original segments, wherein at least two neighboring channel signals are grouped into an original segment, and wherein a loudspeaker is assigned to a first original segment and to a second original segment;

decomposing the at least two channel signals in the first original segment into at least one direct sound component and at least one ambience component, and determining a direction of arrival of the at least one direct sound component for the first original segment, and decomposing the at least two channel signals in the second original segment into at least one direct sound component and at least one ambience component for the second original segment, and determining a direction of arrival of the at least one direct sound component for the second original segment;

adjusting the at least one direct sound component of the first original segment using the playback loudspeaker setup information for the first playback segment to obtain at least one adjusted direct sound component so that a perceived direction of arrival of the at least one direct sound component in the playback loudspeaker setup is identical to the direction of arrival of the first original segment or closer to the direction of arrival of the at least one direct sound component of the first original segment compared to a situation in which no adjusting of the at least one direct sound component has taken place, and adjusting the at least one direct sound component of the second original segment using the playback loudspeaker setup information for the second playback segment to obtain at least one further adjusted direct sound component so that a perceived direction of arrival of the at least one direct sound component in the playback loudspeaker setup is identical to the direction of arrival of the second original segment or closer to the direction of arrival of the at least one direct sound component of the second original segment compared to a situation in which no adjusting of the at least one direct sound component has taken place; and combining the at least one adjusted direct sound component and the ambience components or modified ambience components of a first playback segment and the at least one further adjusted direct sound components and the ambience components or modified ambience components of a second playback segment.

* * * * *